US005460132A

United States Patent [19]

Ishiwata et al.

[11] Patent Number: 5,460,132

[45] Date of Patent: Oct. 24, 1995

[54] FUEL INJECTION PUMP AND PRESTROKE CONTROLLER THEREFOR

[75] Inventors: Hiroshi Ishiwata; Tohru Yokota; Mitsuaki Kobayashi, all of Saitama, Japan

[73] Assignee: Zexel Corporation, Japan

[21] Appl. No.: 359,603

[22] Filed: Dec. 20, 1994

[30] Foreign Application Priority Data

| | | | |
|---|---|---|---|
| Dec. 24, 1993 | [JP] | Japan | 5-073755 U |
| Jul. 27, 1994 | [JP] | Japan | 6-193782 |
| Jul. 27, 1994 | [JP] | Japan | 6-193839 |

[51] Int. Cl.[6] ..... F02M 59/28; F02D 31/00; F02D 1/18

[52] U.S. Cl. ..... 123/364; 123/365; 123/372

[58] Field of Search ..... 123/363, 364, 123/357, 372, 365; 73/517 R, 518, 520

[56] References Cited

U.S. PATENT DOCUMENTS

| | | | |
|---|---|---|---|
| 3,751,993 | 8/1973 | Davis | 73/518 |
| 3,841,111 | 10/1974 | Staudt et al. | 123/364 |
| 3,955,165 | 5/1976 | Stubbs et al. | 73/518 |
| 3,999,441 | 12/1976 | Gonzales | 73/518 |
| 4,263,881 | 4/1981 | Isobe et al. | 123/364 |
| 4,406,263 | 9/1983 | LeBlanc et al. | 123/357 |
| 4,426,970 | 1/1984 | Galis et al. | 123/364 |
| 5,275,140 | 1/1994 | Knoedl et al. | 123/364 |

FOREIGN PATENT DOCUMENTS

| | | |
|---|---|---|
| 3-233144 | 10/1991 | Japan . |
| 3-260339 | 11/1991 | Japan . |

*Primary Examiner*—Thomas N. Moulis
*Attorney, Agent, or Firm*—Ostrolenk, Faber, Gerb & Soffen

[57] ABSTRACT

A fuel injection pump for an engine comprises a magnetic coupling 37 straddling a partition 36 for connecting a timing control rod 6 and a displacement transfer section 34 of a governor so as to enable efficient transfer of rotational force from the displacement transfer section to the timing control rod without need for an oil seal therebetween, and a prestroke controller for the fuel injection pump 131 includes an injection advance adjustment add-on device 136 for conducting prestroke control independently of the magnetic coupling and thereby provide greater freedom in establishing injection timing advance characteristics by enabling injection timing control in response to temperature or load and/or a safety mechanism 237 for ensuring operation of a governor mechanism 20 based on movement of a flyweight 11 even if the magnetic coupling should stick.

25 Claims, 16 Drawing Sheets

Neutral state

Displaced state

FUEL INJECTION PUMP AND PRESTROKE CONTROLLER THEREFOR

BACKGROUND OF THE INVENTION

1. Field of the Invention

This invention relates to a fuel injection pump whose prestroke is controlled by controlling the position of a control sleeve and to a prestroke controller therefor, more particularly to a fuel injection pump prestroke controller which enables prestroke to be controlled independently of one or more flyweights utilized for adjusting the fuel injection timing advance characteristic, and still more particularly to a fuel injection pump prestroke controller wherein displacement produced by the lift of one or more flyweights is transferred using a magnetic coupling.

2. Prior Art

A commonly employed type of fuel injection pump with adjustable prestroke varies the prestroke by controlling the position of a control sleeve fitted on the plunger of the fuel injection pump.

As this type of fuel injection pump is equipped with an electromagnetic prestroke actuator for controlling the position of the control sleeve, however, it is expensive to manufacture. Therefore, as taught in Japanese Patent Disclosure No. Hei 3-260339, for example, mechanical prestroke actuators were developed for reducing production cost. In the mechanical prestroke actuator, since the timing control rod is positionally controlled by the centrifugal force of one or more governor flyweights, it has to be extended into the interior of the governor housing for connecting it with the displacement transfer section of the governor.

However, since the interior of the main pump unit where the timing control rod is located is filled with fuel, while the interior of the governor housing is filled with engine oil, this arrangement is disadvantageous in that any fuel that leaks from the main pump unit will dilute the engine oil and degrade its lubrication performance.

Because of this, the practice has been to prevent fuel leakage by providing a fuel seal ring or an oil seal ring at the point where the timing control rod passes through the wall of the main pump unit.

This is not an altogether satisfactory solution, however, because fuel leakage is apt to occur anyway with increasing wear of the fuel seal ring or the oil seal ring and also because the increased resistance of the fuel seal ring or oil seal ring when the engine is cold, as when it is first started, degrades the displacement transfer performance.

Another drawback of the prior art configuration is that sticking of the control sleeve or timing control rod disables not only the control by the control sleeve but also the ability of the governor to control the fuel injection quantity.

In some prior art fuel injection pumps the fuel injection timing advance characteristic is adjusted by controlling the prestroke. In the fuel injection pump disclosed in Japanese Patent Disclosure No. Hei 3-233144, for example, the prestroke is adjusted and the fuel injection timing is controlled by utilizing the movement of the governor flyweight(s) as a source of driving power for operating the timing control rod.

In a fuel injection pump equipped with a plunger which sucks in and pressurizes fuel by reciprocating axially, the prestroke refers to the stroke of the plunger between its bottom dead point and the point at which pressurized fuel delivery starts. The fuel injection characteristic appropriate for the engine operating condition is obtained by shortening the prestroke to cause the fuel injection to start earlier (injection timing advance) or lengthening it to cause the fuel injection to start later (injection timing retard).

The prestroke controller for a fuel injection pump taught by the aforesaid Japanese Patent Disclosure No. Hei 3-233144 will be briefly explained with reference to FIG. 1.

FIG. 1 is a perspective view of the fuel injection pump prestroke controller, designated by reference numeral 1, and a conventional mechanical governor, designated reference numeral 2. On the side of the main pump unit 3 are shown a plunger 4, a control sleeve 5, and a timing control rod 6 whose engagement pin 8 is engaged with an engagement groove 7 of the control sleeve 5.

On the side of the mechanical governor 2, a cam shaft 9 for reciprocating the plunger 4 in the main pump unit 3 is fitted with a guide sleeve 10 and a flyweight 11 is connected with the guide sleeve 10.

The fuel injection pump prestroke controller 1, which comprises the flyweight 11 as a component utilized in common with the mechanical governor 2, further has a tension lever 13 serving as a prestroke control lever which pivots around a stationary pivot shaft 12 in accordance with the movement of the flyweight 11, a timing cam 14, a counterweight 15 connected with the timing control rod 6, and a cam surface abutment piece 16 formed integrally with the counterweight 15.

The timing cam 14 is connected with one side of the free end of the tension lever 13 through a connection lever 17 and is rotatable around a stationary pivot shaft 18. A cam surface abutment projection 16A of the cam surface abutment piece 16 is pressed onto the cam surface 14A of the timing cam 14 at a prescribed pressure by the force of a counterweight spring 19 (return spring).

The other side of the free end of the tension lever 13 is connected with a torque cam 21 which is part of a governor mechanism 20 of the mechanical governor 2. Although this is for enabling the governor mechanism 20 to automatically control the fuel injection quantity in response to variation in engine load, the governor mechanism 20 will not be described in detail here.

An injection quantity control rack 22 is provided in association with the torque cam 21. The injection quantity control rack 22 controls the fuel injection quantity by rotating the plunger 4 about its own axis.

In the fuel injection pump prestroke controller 1 of the aforesaid configuration, an increase in engine speed (pump speed) increases the centrifugal force of the flyweight 11 causing it to shift and slide the guide sleeve 10 along the cam shaft 9 to the right in FIG. 1. As a result, the tension lever 13 rotates about the stationary pivot shaft 12, whereby the mechanical governor 2 performs the prescribed governor function and the timing cam 14 is rotated about the stationary pivot shaft 18 by the connection lever 17.

Since this rotation of the timing cam 14 changes the positional relationship between the timing control cam surface 14A and the cam surface abutment projection 16A of the cam surface abutment piece 16, the cam surface abutment piece 16 and the counterweight 15 are rotated about the axis of the timing control rod 6.

The resulting rotation of the timing control rod 6 by a corresponding angle moves the control sleeve 5 vertically and changes the positional relationship between the control sleeve 5 and the plunger 4, thus changing the fuel injection timing or the prestroke.

Thus, as explained in the foregoing, the prestroke controller 1 controls the start of pressurized fuel delivery by the main pump unit 3 by varying the vertical positional relationship between the control sleeve 5 and the plunger 4, and the operation of the timing control rod 6 for varying the position of the control sleeve 5 relies on the use of the flyweight 11 and the tension lever 13 in common with the governor mechanism 20.

Since the flyweight 11 utilized by the prior art prestroke controller 1 moves with increasing engine speed, the prestroke controller 1 is capable of providing the injection timing advance characteristic required of a speed timer for varying the injection timing as a function of engine speed. The prior art prestroke controller 1 thus has the drawback of being all but impossible to apply for controlling prestroke in accordance with an injection timing advance characteristic during operation in a cold external environment or in response to changes in the amount of accelerator depression or the engine load state.

An object of the first aspect of the invention is to overcome the aforesaid problems of the prior art technology by providing a fuel injection pump capable of efficiently transferring the rotational force of the displacement transfer section of a governor to the timing control rod of the main pump unit without use of an oil seal or the like.

An object of the second aspect of the invention is to provide a fuel injection pump prestroke controller which employs a magnetic coupling and, by utilizing the fact that the secondary side of the magnetic coupling (driven side internal magnet) can be controlled to a desired position without relying on the driving force of the flyweight on the primary side (driving side external magnet), imparts speed timer capability to the prestroke controller, thereby increasing the degree of freedom of its injection timing advance characteristic and enabling it to conduct injection timing advance in response to temperature and load.

Still another object of the invention is to provide a fuel injection pump prestroke controller capable of conducting low-temperature injection timing advance and low-load injection timing advance independently of engine speed, i.e., of flyweight lift.

SUMMARY OF THE INVENTION

For achieving one of the aforesaid objects, the first aspect of the invention provides a fuel injection pump for an engine comprising a main pump unit, a timing control rod, a control sleeve whose position is varied by the timing control rod for controlling injection timing, a partition for separating the timing control rod from a displacement transfer section of a mechanical governor, and a magnetic coupling straddling the partition, the position of the control sleeve being controlled by transferring rotation of the displacement transfer section caused by centrifugal force of a flyweight to the timing control rod through the magnetic coupling.

The second aspect of the invention takes advantage of the fact that, in the configuration according to the first aspect of the invention, it is possible to control the timing control rod independently of the flyweight lift by applying to the timing control rod a force that is larger than the force being transferred by the magnetic coupling and, further, to provide an add-on device for adjusting injection timing advance in association with the timing control rod on the side of the magnetic coupling opposite from the mechanical governor. More specifically, the second aspect of the invention provides a prestroke controller for an engine fuel injection pump comprising a plunger which sucks in and pressurizes fuel by reciprocating axially in response to rotation of a cam shaft connected with the engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, and an add-on device for injection advance adjustment engageable with the timing control rod for controlling the prestroke independently of the magnetic coupling.

The add-on device for injection advance adjustment can be constituted as a temperature injection timing advance member.

The add-on device for injection advance adjustment can also be constituted as a load injection timing advance member.

In accordance with the first aspect of the invention, since the timing control rod and the displacement transfer section are separated by the partition and no through-hole is provided in the wall of the main pump unit, fuel leakage cannot occur. Sufficient displacement transfer can be achieved despite the presence of the partition, however, since the timing control rod and the displacement transfer section are connected by the magnetic coupling straddling the partition.

In the prestroke controller for fuel injection pump in accordance with the second aspect of the invention, since the magnetic coupling enables the timing control rod to be controlled from one side of a mechanical governor in response to the lift of a flyweight and the add-on device for injection advance adjustment enables the rotation of the timing control rod to be controlled on the side of the main pump unit, the control sleeve can be controlled by rotating the timing control rod in the appropriate direction independently of the displacement transferred via the magnetic coupling in response to the lift of the flyweight. This is particularly advantageous during low-temperature or low-load operation because it allows the prestroke to be adjusted to achieve the required fuel injection timing irrespective of the engine speed.

The invention thus makes it possible for a low-cost mechanical system to achieve a stable injection timing advance characteristic which is as good as that obtainable with more expensive electronic prestroke control.

The above and other features of the invention will become apparent from the following description made with reference to the drawings.

DETAILED DESCRIPTION OF THE PREFERRED EMBODIMENTS

An embodiment of the fuel injection pump according to the first aspect of the invention will be explained with reference to FIGS. 2 to 4.

Figure 2:
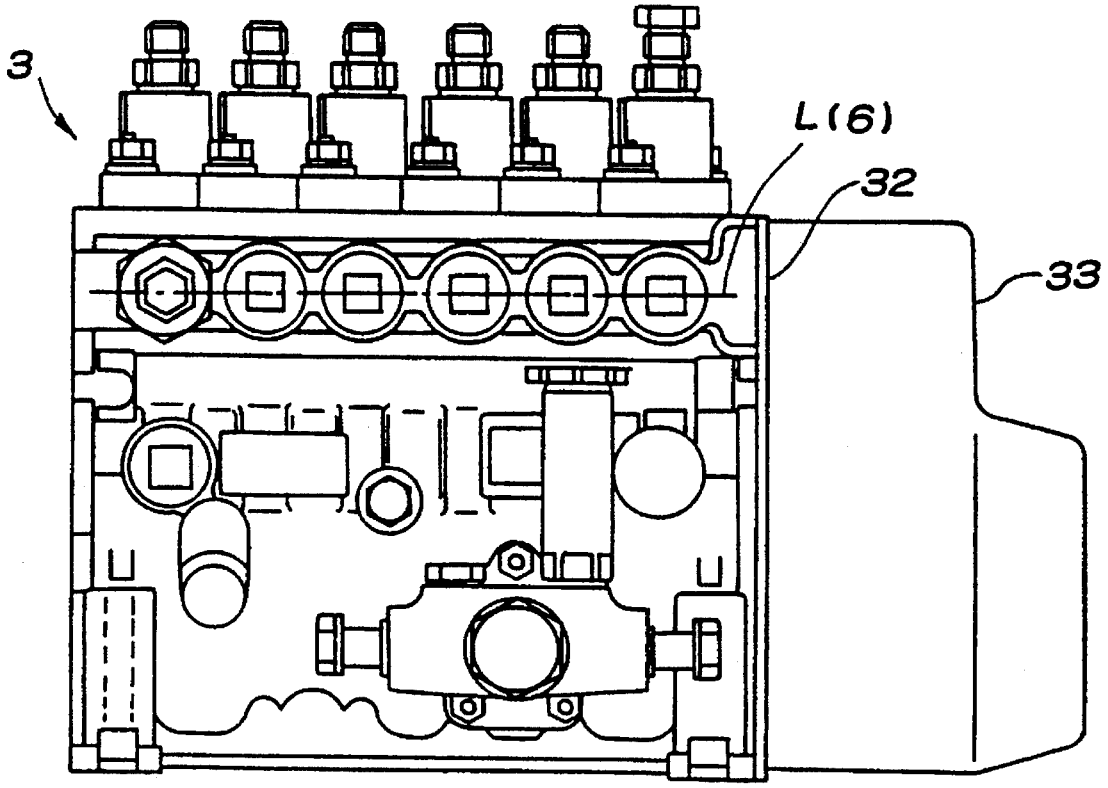
FIG. 2 is a front view of an embodiment of the fuel injection pump according to the first aspect of the invention.
Figure 3:
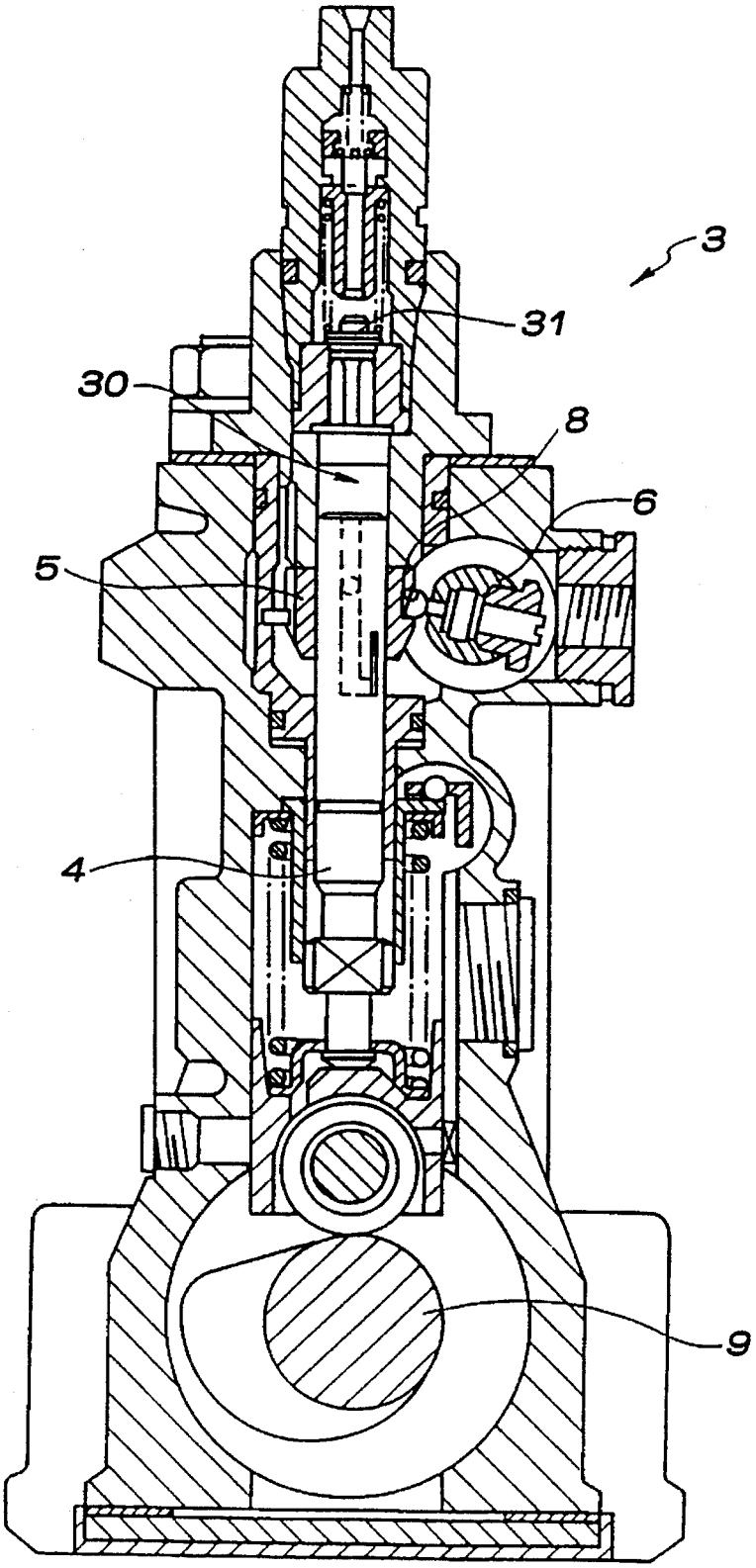
FIG. 3 is a sectional view of a main pump unit 3.

Reference numeral 3 in FIG. 2 indicates the main pump unit of a fuel injection pump. The main pump unit 3 includes six plungers 4 of the configuration shown in FIG. 3, one associated with each cylinder of the engine. The plungers 4 are driven by a cam shaft 9 as it rotates synchronously with the engine. More specifically, the rotation of the cam shaft 9 causes the plungers 4 to rise and fall in a predefined order so that each compresses fuel in its fuel chamber 30 and delivers the compressed fuel through a delivery valve 31 to an injection nozzle (not shown) of the engine (not shown).

Each plunger 4 of a pump of this type has a control sleeve 5 fitted thereon. The control sleeve 5 is engaged with an engagement pin 8 of a timing control rod 6 so as to be raised and lowered when the engagement pin 8 rotates owing to rotation of the timing control rod 6. As a result, the prestroke of the fuel injection pump can be varied by rotating the timing control rod 6 to control the vertical position of the control sleeve 5.

The prestroke is defined as the cam lift up to the point where the upper end of the plunger 4 closes the fuel suction and discharge hole of the plunger barrel and is determined by the vertical position of the control sleeve 5.

At a lower position of the control sleeve 5 the time of fuel injection is early and the fuel delivery rate low, while at a higher position of the control sleeve 5 the time of fuel injection is late and the fuel delivery rate is high.

Figure 4:
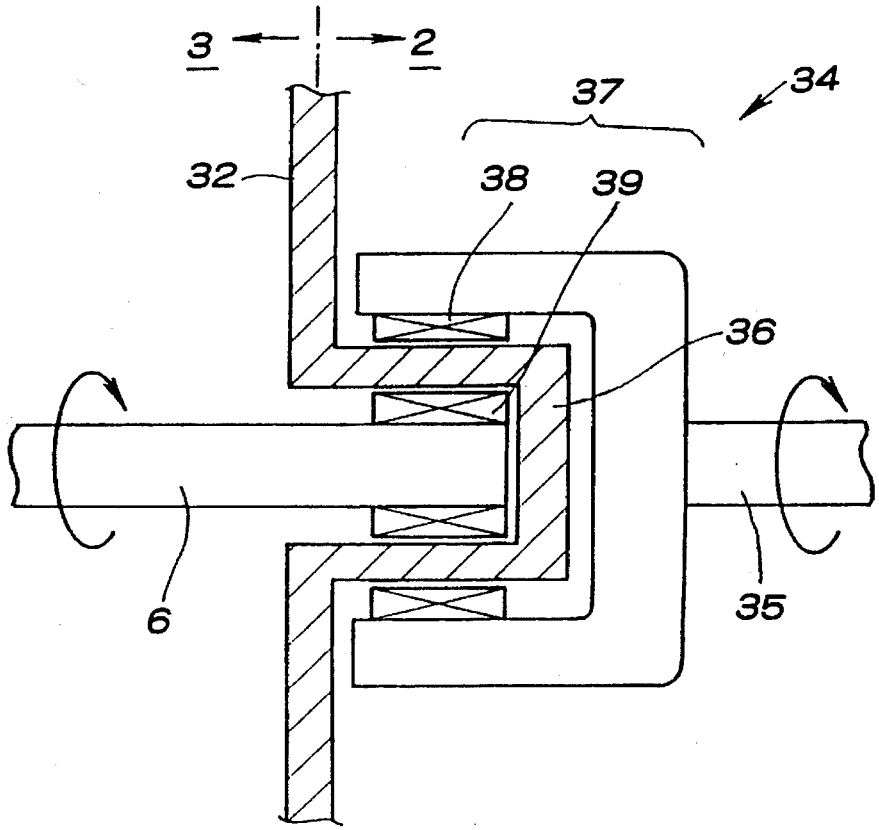
FIG. 4 is an enlarged view of an essential portion, showing the magnetic coupling 37 of a connection section (displacement transfer section 34) between the mechanical governor 2 and the main pump unit 3.

As shown in FIG. 2, the timing control rod 6 lies along a line L and its one end portion passes through a wall portion 32 of the main pump unit 3 into a governor housing 33 where it is connected with a displacement transfer section 34 (FIG. 4).

FIG. 4 is an enlarged view of an essential portion of the coupling between the mechanical governor 2 and the main pump unit 3 (displacement transfer section 34) in the fuel injection pump. Specifically, a displacement transfer shaft 35 which receives the displacement of a flyweight 11 through a tension lever 13 and the like (FIG. 1) and transfers it to the timing control rod 6 is coupled with the timing control rod 6 by a magnetic coupling 37 straddling a partition 36 which separates the timing control rod 6 from the displacement transfer shaft 35.

The displacement transfer section 34 is connected with the flyweight 11 of the mechanical governor 2 through a linkage so as to be rotated utilizing the centrifugal force of the flyweight 11. The amount of rotational displacement of the displacement transfer section 34 is controlled in accordance with the change in the degree of opening of the flyweight 11 which changes with the rotational speed of the pump.

The magnetic coupling 37 has a driving side external magnet 38 located on an inner wall portion at the end of the displacement transfer shaft 35 and a driven side internal magnet 39. The rotation of the displacement transfer shaft 35 transmits through the magnetic coupling 37 to transfer a rotational force to the timing control rod 6.

Since in the prior art fuel injection pump the timing control rod 6 passes through the wall portion 32 of the main pump unit 3 into the governor housing 33 where it connects with the displacement transfer section 34, there is the risk that the engine oil in the governor housing 33 will be diluted and have its lubrication performance degraded by fuel leaking into the governor housing 33 from the main pump unit 3.

In the aforesaid configuration according to this embodiment, however, the presence of the partition 36 between the displacement transfer section 34 of the mechanical governor 2 and the timing control rod 6 precludes any such fuel leakage.

Moreover, the magnetic coupling 37 couples the displacement transfer shaft 35 and the timing control rod 6 so as to enable transfer of rotational force therebetween.

In other words, the timing control rod 6 does not pass through the wall portion 32 of the main pump unit 3 and its end portion is not mechanically connected with the displacement transfer section 34 but, instead, is coupled therewith by the magnetic force of the magnetic coupling 37.

Since this configuration eliminates the need for a fuel seal ring or oil ring, the problems that might otherwise be caused by such rings do not occur and rotational force can be transferred with relatively high accuracy free from the risk of fuel leakage.

In accordance with this embodiment, moreover, the governor flyweight 11 connected with the displacement transfer section 34 is, as mentioned earlier with reference to FIG. 1, also connected via a linkage with the injection quantity control rack 22. Therefore, if the prior art arrangement should be adopted, sticking of the control sleeve 5, the timing control rod 6 or the like would not only prevent transfer of the rotational force to the timing control rod 6 but also prevent the transfer of control force to the injection quantity control rack 22 and, as a result, disable the injection quantity control function.

This problem does not arise in this embodiment, however, because the torque produced by the rotational force of the flyweight 11 and transferred to the injection quantity control rack 22 is larger than the torque transferred to the timing control rod 6 by the magnetic coupling 37. Therefore, sticking of the control sleeve 5 or the timing control rod 6, even if it should occur, does not affect the control force directed to the injection quantity control rack 22 by the flyweight 11. Thus in addition to its other effects this embodiment also has the effect of preventing loss of the injection quantity control function.

The various merits obtained by utilizing the magnetic coupling 37 of the aforesaid configuration for the transfer of torque include: that the structure can be made simpler and more reliable than in the case of the conventional mechanical governor 2 requiring a fuel seal, that low temperature operation is made possible, that the injection quantity control function of the mechanical governor 2 is not lost even if the control sleeve 5 should stick for some reason, that forces produced by external disturbances can be canceled by the counterweight 15 (FIG. 1), and that the absence of contact with the controlled member (the timing control rod 6) ensures that the injection quantity control function of the mechanical governor 2 is not affected during idling.

Figure 5A:
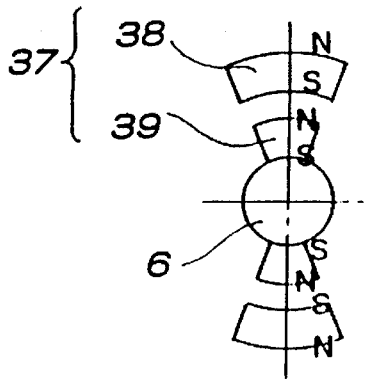
FIG. 5 is a schematic sectional view of an essential portion of the magnetic coupling 37 viewed from the side of the mechanical governor 2 toward the main pump unit 3 and showing a driving side external magnet 38 and a driven side internal magnet 39 in their neutral state and in their state as displaced from each other by an angle θ.
Figure 5B:
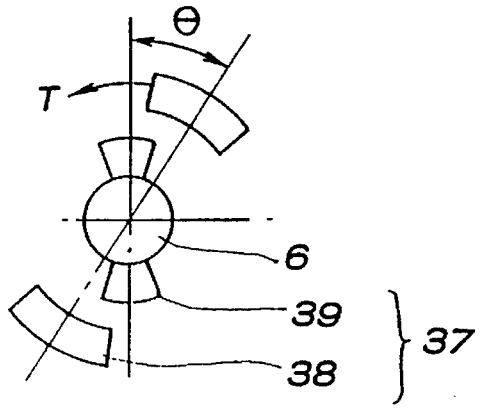
Figure 6:
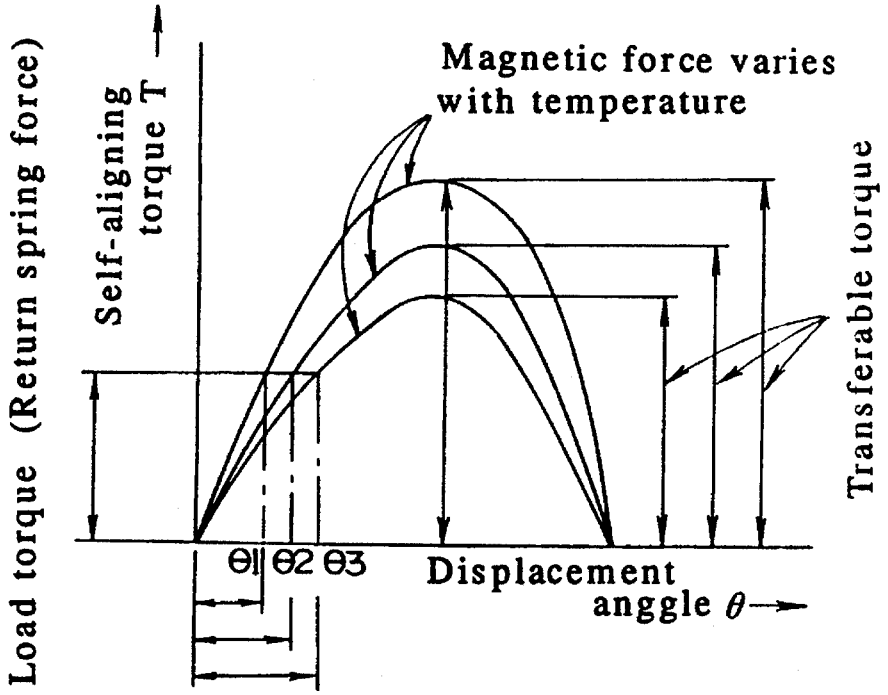
FIG. 6 is a graph showing the relationship between the displacement angle θ and a self-aligning torque T.

Moreover, as can be seen in FIG. 5 showing the magnetic coupling 37 as viewed from the side of the mechanical governor 2 toward the main pump unit 3, a self-aligning torque T arises when the driving side external magnet 38 and the driven side internal magnet 39 are offset from their neutral state by an angle θ. The characteristics of the self-aligning torque T are shown in FIG. 6.

When the magnetic coupling 37 is utilized for torque transfer, it is able to transfer the peak value of the self-aligning torque.

The magnetic force of a magnetic such as the driving side external magnet 38 or the driven side internal magnet 39 varies with temperature. For example, a ferrite magnet demagnetizes at low temperatures while a neodymium magnet demagnetizes at a high temperature. Because of this, the displacement of the driven side internal magnet 39 on the output side produced by a given displacement of the driving side external magnet 38 on the input side decreases by an angle proportional to the load torque (approximately equal to the force which the counterweight spring 19 (FIG. 1) applies to the timing control rod 6) at each of angles θ1, θ2, θ3.

Thus when torque is transferred by angular displacement in this way, a deviation proportional to the self-aligning torque T occurs in the angle θ.

This gives rise to the problem that the minimum prestroke position (maximum injection timing advance position) varies with the ambient temperature.

Figure 7:
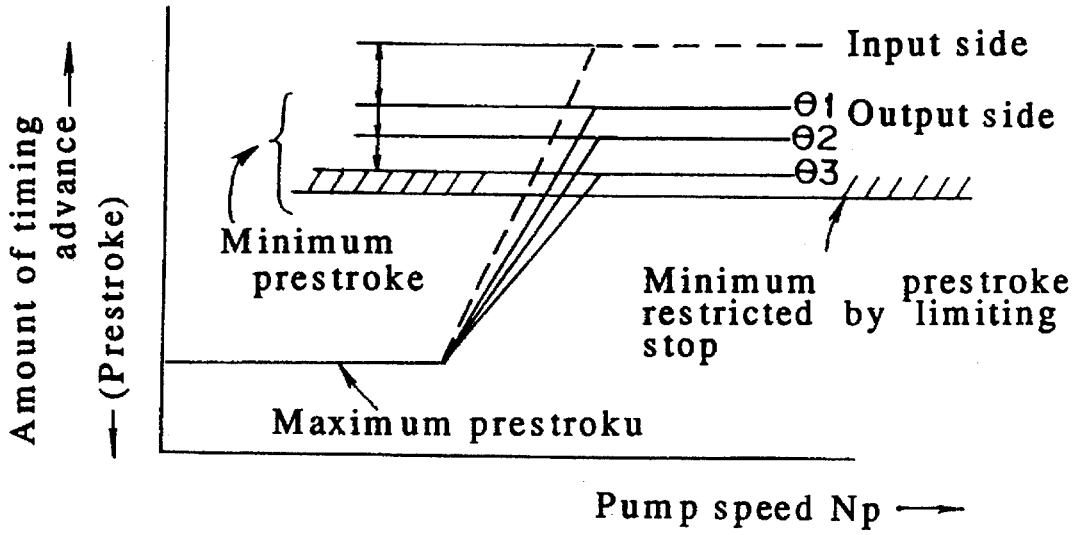
FIG. 7 is a graph showing how the amount of timing advance (prestroke) varies with pump speed Np.

In other words, as shown in FIG. 7, owing to the temperature dependency of the driving side external magnet 38 and the driven side internal magnet 39, the amount of timing advance (prestroke) for a given pump speed Np, specifically the minimum prestroke, is not constant, creating the problem that the amount of timing advance is destabilized by the ambient temperature.

The third aspect of the invention therefore provides a prestroke controller for a fuel injection pump which, while maintaining the advantages realized by utilizing a magnetic coupling, makes it possible to prevent variation in the minimum prestroke position owing to changes in the ambient temperature.

Specifically, the third aspect of the invention provides a prestroke controller for an engine fuel injection pump comprising a plunger which sucks in and pressurizes fuel by reciprocating axially in response to rotation of a cam shaft connected with the engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, a counterweight attached to the timing control rod, and a limiting stop provided opposite the counterweight for determining a minimum prestroke independently of the magnetic coupling.

Since the third aspect of the invention provides the limiting stop for determining the minimum prestroke on the output side of the magnetic coupling, i.e. on the timing control rod side to which the displacement is transferred, variations in the torque produced by the magnets as a result of changes in the ambient temperature are prevented from varying the minimum prestroke position. The minimum prestroke can therefore be secured with high consistency.

The prestroke controllers according to the second and third aspects of the invention will now be explained with reference to FIGS. 8 to 23, it being understood that each of these prestroke controllers is used in conjunction with a fuel injection pump equipped with a magnetic coupling according to the first aspect of the invention (the magnetic coupling shown in FIG. 4, for example).

The prestroke controller for a fuel injection pump according to the second aspect of the invention will be explained first with reference to FIGS. 8 and 9, in which portions similar to those in FIGS. 1 to 7 are assigned the same reference symbols as those in FIGS. 1 to 7 and will not be explained further here.

Figure 8:
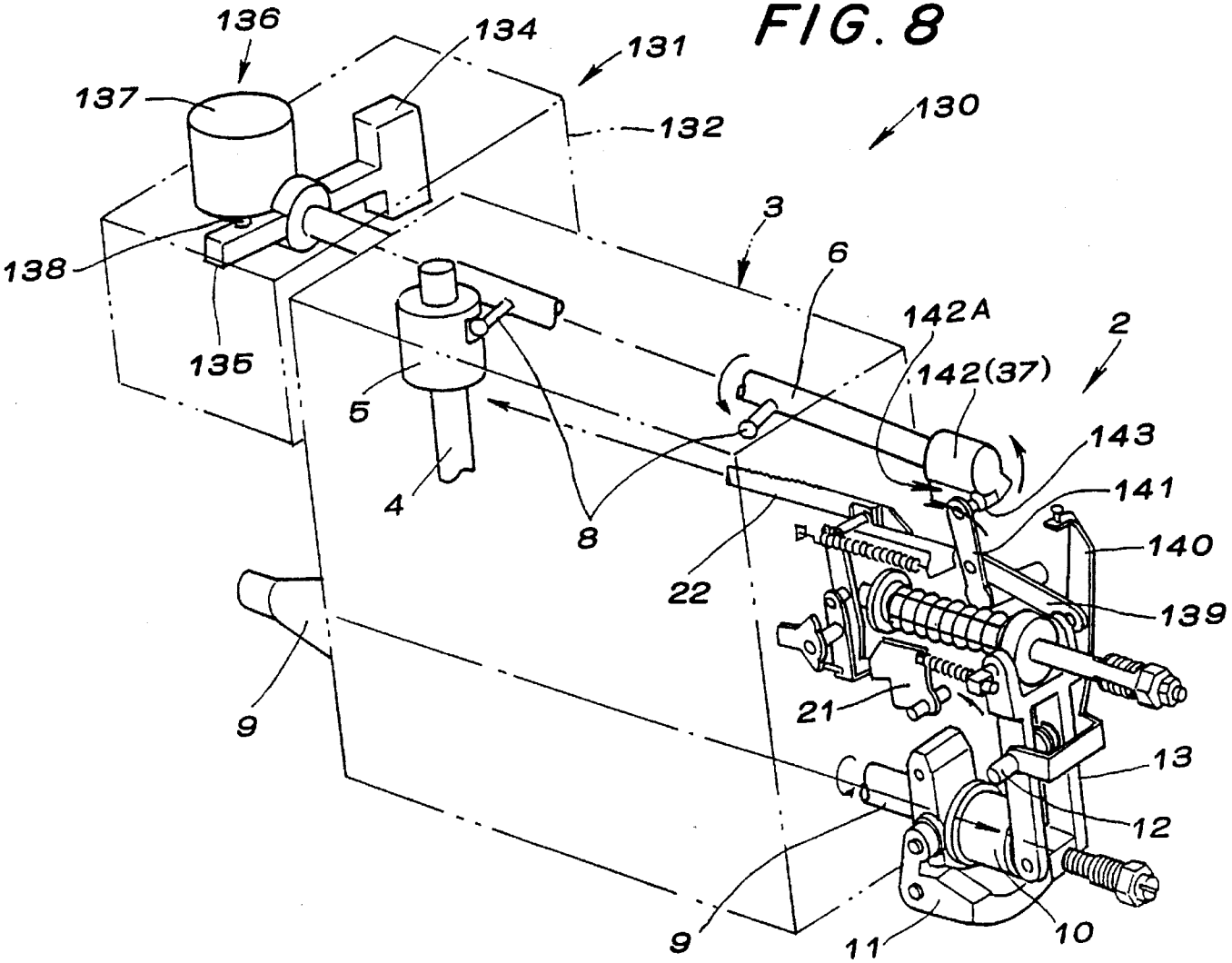
FIG. 8 is a schematic perspective view of a fuel injection pump 130 equipped with a prestroke controller 131 according to a basic embodiment (first embodiment) of the second aspect of the invention.

FIG. 8 is a schematic perspective view of a fuel injection pump 130. The fuel injection pump 130 comprises an in-line main pump unit 3, a prestroke controller 131 which is a basic embodiment (first embodiment) of the second aspect of the invention, and a mechanical governor 2.

Figure 9:
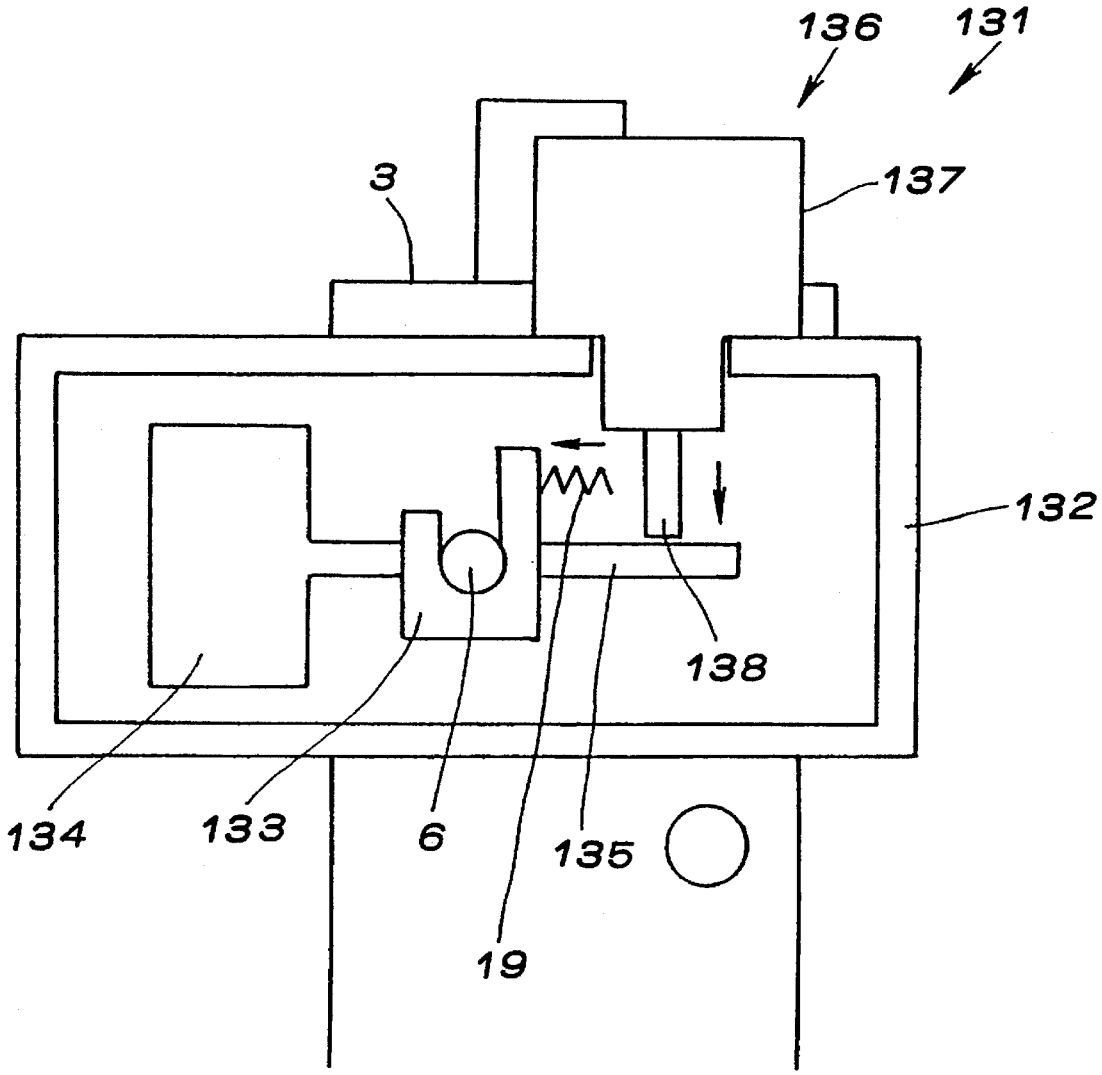
FIG. 9 is a sectional side view of the prestroke controller 131 as seen from the side of a counterweight case 132 opposite from that of the mechanical governor 2.

FIG. 9 is a sectional side view of the prestroke controller 131 as seen from the side of a counterweight case 132 opposite from that of the mechanical governor 2. The prestroke controller 131 comprises a U-shaped lever 133, a counterweight 134, an abutment lever 135 and an injection advance adjustment add-on device 136 positioned opposite the abutment lever 135.

The injection advance adjustment add-on device 136 has a device housing 137 and a control shaft 138. The control shaft 138 projects/retracts or moves with respect to the device housing 137 in response to changes in an engine operating condition such as the engine load or the degree of depression of the accelerator pedal or changes in the ambient temperature. Since the position at which the control shaft 138 abuts on the abutment lever 135 therefore changes accordingly, it is able to control (adjust) the prestroke by appropriately restricting the rotation of the timing control rod 6.

The counterweight 134 and the timing control rod 6 are constantly urged in the direction of injection timing retard by a compression return spring 19 acting thereon through the U-shaped lever 133.

On the mechanical governor 2 side of the prestroke controller 131, the prestroke can be controlled in accordance with the engine speed (pump speed) by co-utilizing the flyweight 11 of the mechanical governor 2.

More specifically, a tension lever 13 (similar to that shown in FIG. 1) has an intermediate link 139 and a guide lever 140 attached thereto, and a control lever (sensor lever) 141 is attached to the intermediate link 139.

A cylindrical cam 142 is fitted on the end portion of the timing control rod 6 opposite the mechanical governor 2 and an abutment pin 143 of the control lever (sensor lever) 141 is abutted on the cam surface 142A of the cylindrical cam 142.

The magnetic coupling 37 (FIG. 4) is built into the cylindrical cam 142 and the rotation of the cylindrical cam 142 is transferred to the timing control rod 6 through the magnetic coupling 37. The control sleeve 5 can therefore for be moved vertically with respect to the plunger 4 to adjust the prestroke in the manner explained earlier.

The profile of the cam surface 142A is determined in light of the desired prestroke control characteristic. In the illustrated example it consists of a combination of a flat portion extending linearly from the side of the timing control rod 6 and an ensuing curved portion.

In addition, an injection quantity control rack 22 is provided in association with a torque cam 21. The injection quantity control rack 22 controls the fuel injection quantity by rotating the plunger 4 about its axis.

Figure 1:
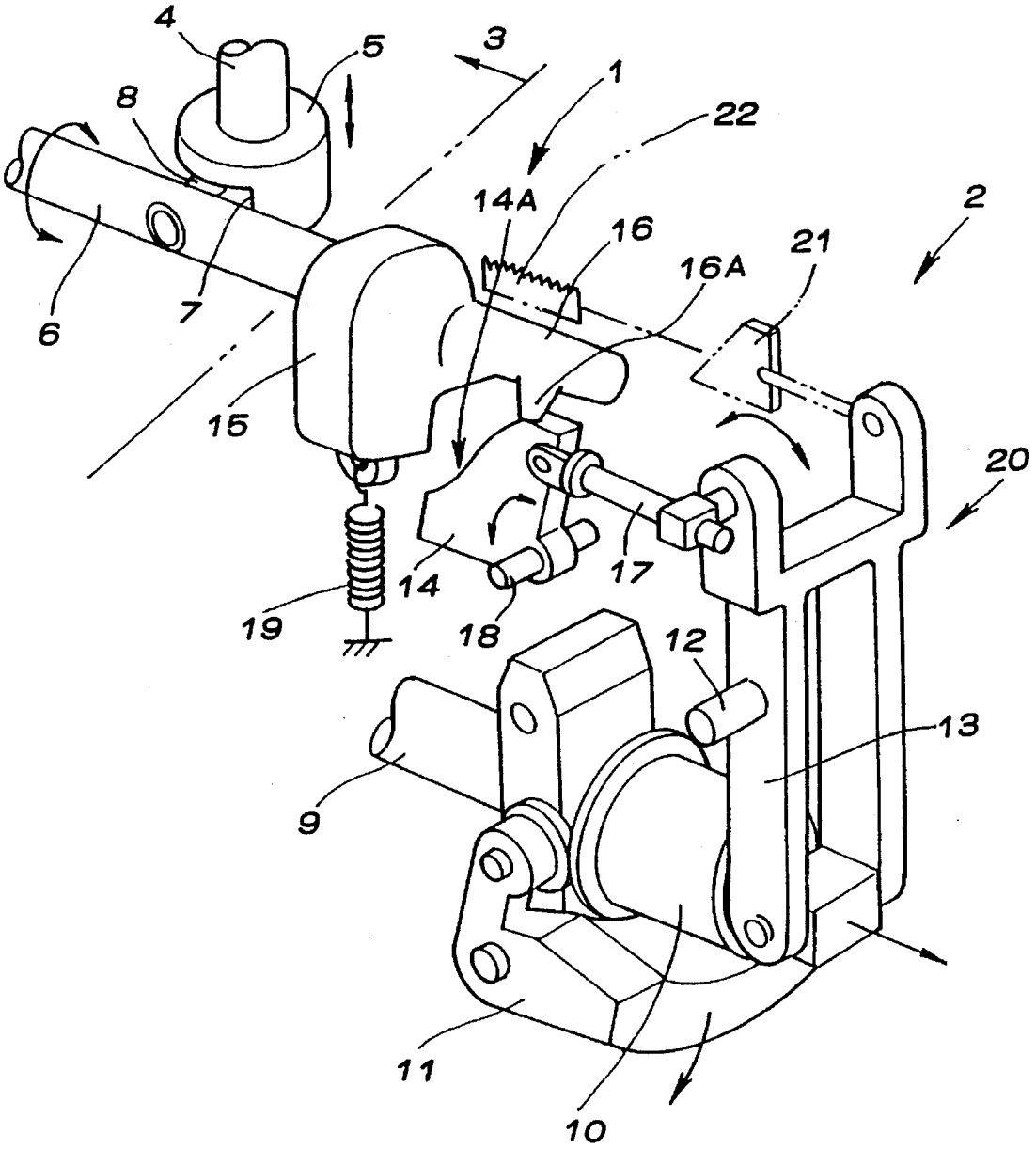
FIG. 1 PRIOR ART
FIG. 1 is a schematic perspective view of a prior art prestroke controller 1 for a fuel injection pump and a prior art mechanical governor 2.

The prestroke controller 131 configured in the foregoing manner operates similarly to the fuel injection pump prestroke controller 1 of FIG. 1 in the point that the movement of the flyweight 11 with increasing engine speed is used to rotate the tension lever 13 and, in turn, to rotate the intermediate link 139 and the control lever 141 in the direction of the arrow.

As a result, the abutment pin 143 pushes against the cam surface 142A of the cylindrical cam 142 to rotate the cylindrical cam 142 counterclockwise in FIG. 8 and the resulting rotation of the timing control rod 6 is transferred to the engagement pin 8 which lowers the control sleeve 5, thereby shortening the prestroke and advancing the fuel injection timing.

The injection timing advance characteristic thus varies with the speed of the main pump unit 3 and is based on a so-called speed timer function. However, since the cylindrical cam 142 does not adopt the mechanically connected direct-acting system of the prior art prestroke controller 1 but instead employs the magnetic coupling 37, the driven side internal magnet 39 can rotate or stop independently of the rotation of the driving side external magnet 38 of the cylindrical cam 142.

More specifically, the control sleeve 5 can be lowered and the fuel injection timing advanced even before the flyweight 11 has moved sufficiently to rotate the cylindrical cam 142 because the timing control rod 6 can be independently rotated in the counterclockwise direction in FIG. 8 by extending the control shaft 138 of the injection advance adjustment add-on device 136.

The prestroke can therefore be controlled independently of the movement of the flyweight 11 with increasing engine speed.

Figure 10:
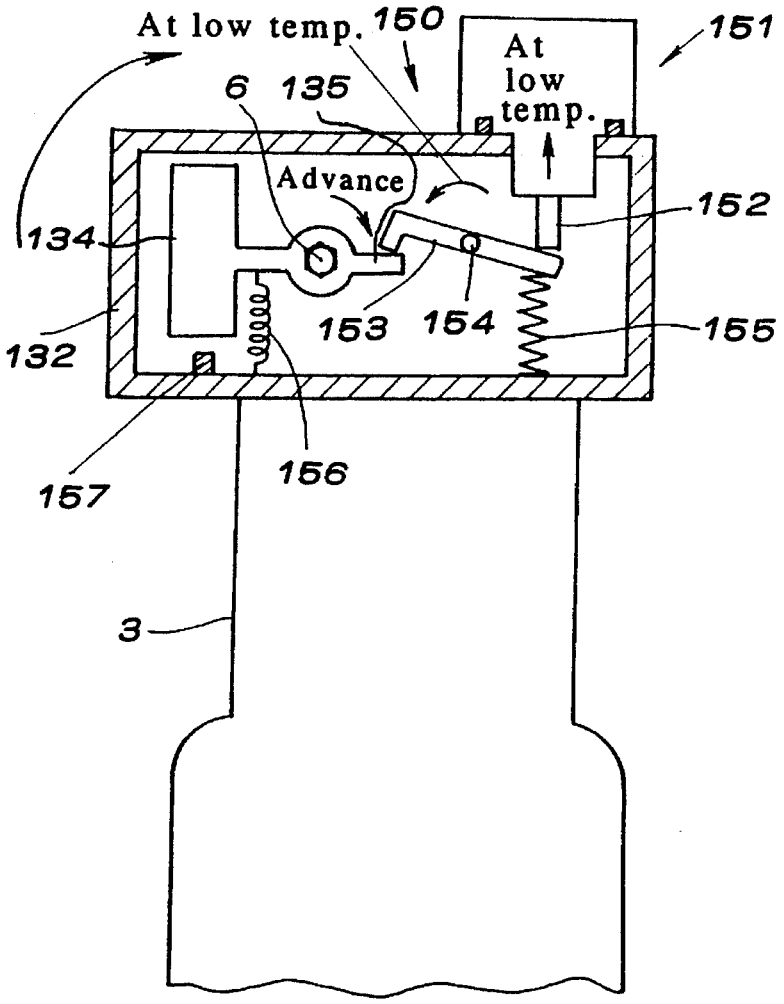
FIG. 10 is a sectional side view showing a prestroke controller 150 (second embodiment) employing an injection advance adjustment add-on device 136 for establishing a temperature injection advance characteristic.
Figure 11:
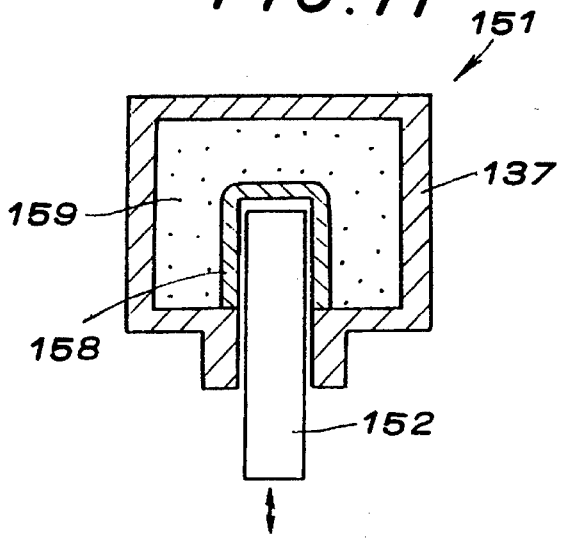
FIG. 11 is an enlarged sectional view of a wax device 151 of the prestroke controller 150.

FIGS. 10 and 11 show a prestroke controller 150 (second embodiment) employing an injection advance adjustment add-on device 136 for establishing a temperature injection advance characteristic. The mechanical governor 2 section of the prestroke controller 150 is the same as that of the prestroke controller 131 of FIG. 8, while in the counterweight case 132 portion a wax device 151 is used as the injection advance adjustment add-on device 136.

In addition, an intermediate lever 153 is provided between a control shaft 152 (corresponding to the control shaft 138 (FIG. 9)) and the abutment lever 135, and a compression spring 155 is provided to urge the intermediate lever 153 counterclockwise around a stationary shaft 154.

The counterweight 134 is provided with tension spring 156 which urges it in the timing retard direction and with a retard side stop 157.

As shown in the enlarged view of FIG. 11, the wax device 151 has a device housing 137, the control shaft 152, a compressible rubber member 158 and wax 159 charged into the space between the compressible rubber member 158 and the device housing 137.

Expansion of the wax 159 at high temperatures causes the control shaft 152 to project outward and rotate the intermediate lever 153 clockwise, while contraction thereof at low temperatures allows the force of the compression spring 155 to press the control shaft 152 inward while rotating the intermediate lever 153 counterclockwise.

As a result, an injection timing advance characteristic can be realized during low-temperature operation owing to the fact that the inward movement of the control shaft 152 allows the intermediate lever 153 to rotate counterclockwise for rotating the abutment lever 135 (and in turn the counterweight 134) clockwise and thus causing the timing control rod 6 to push down the control sleeve 5.

Figure 12:
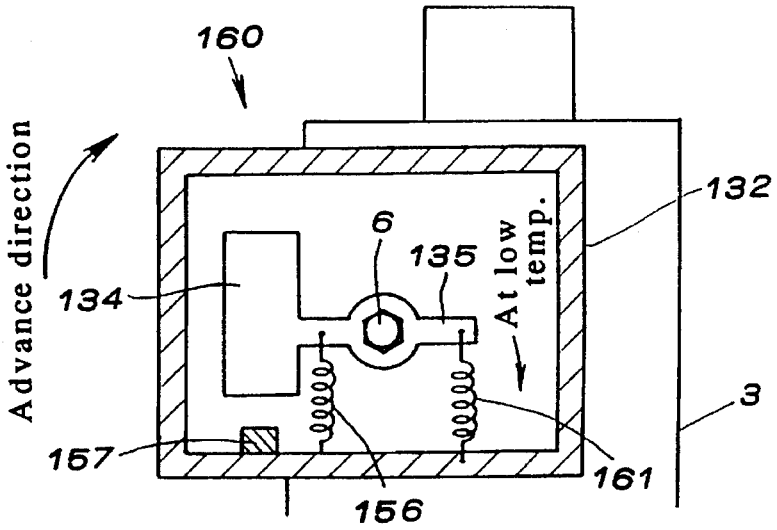
FIG. 12 is a sectional side view showing a prestroke controller 160 (third embodiment) in which the injection advance adjustment add-on device 136 employs a shape memory alloy spring 161.
Figure 13:
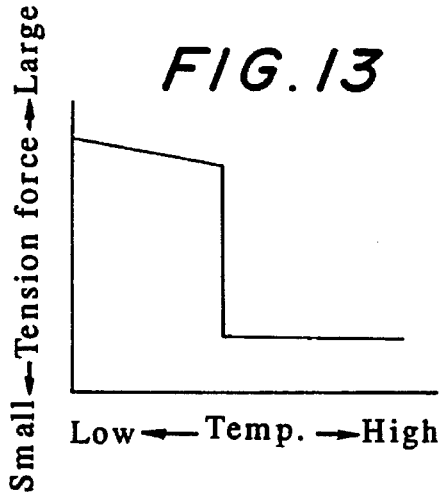
FIG. 13 is a graph showing the temperature characteristic of the shape memory alloy spring 161.

FIG. 12 is a sectional view showing a prestroke controller 160 (third embodiment) in which the injection advance adjustment add-on device 136 employs a shape memory alloy spring. Specifically, the injection advance adjustment add-on device 136 is constituted of a shape memory alloy spring 161 attached between the counterweight case 132 and the abutment lever 135.

The shape memory alloy spring 161 can be constituted of any material exhibiting temperature sensitivity. For example, a ferrite magnetic material is known to experience a rapid loss of magnetization when its temperature falls below a certain level. This makes it possible to utilize the characteristic shown in FIG. 13, wherein the tension force is large at high temperatures and low at high temperatures.

The prestroke controller 160 is thus able to provide an injection timing advance characteristic at low temperatures similar to the prestroke controller 150 of FIG. 10.

Figure 14:
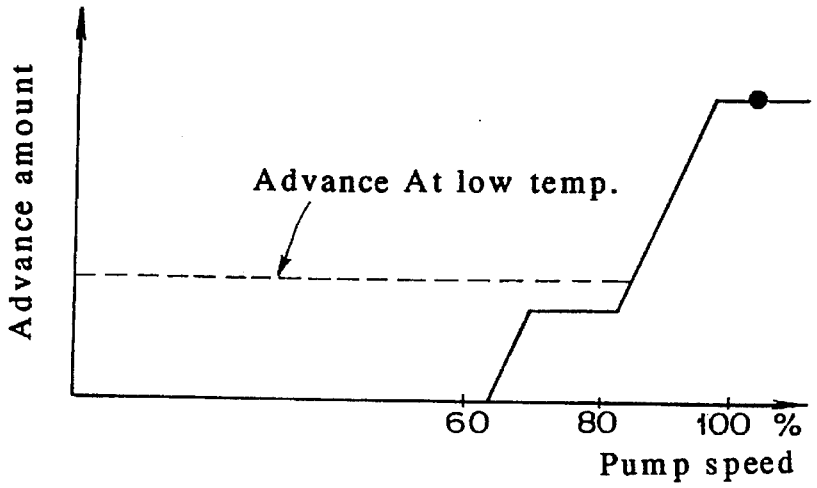
FIG. 14 is a graph showing the injection timing advance characteristics of the prestroke controllers 150 and 160.

FIG. 14 is a graph showing the injection timing advance characteristic of the prestroke controllers 150 and 160. At normal temperature the mechanical governor 2 section functions as an ordinary speed timer (solid line curve), while at low temperatures the wax device 151 of the prestroke controller 150 or the shape memory alloy spring 161 of the prestroke controller 160 establishes a low-temperature timing advance (broken line) independently of the displacement transfer by the cylindrical cam 142 portion in the mechanical governor 2.

Figure 15:
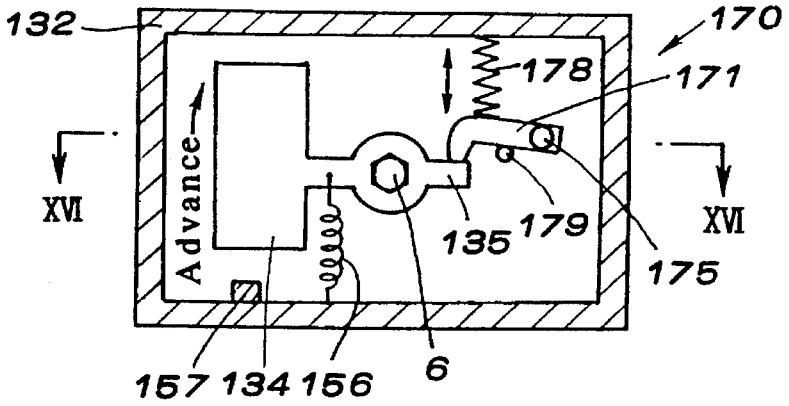
FIG. 15 is a sectional view showing a prestroke controller 170 (fourth embodiment) whose injection timing advance characteristic varies in response to the degree of depression of an accelerator pedal or the engine load condition.
Figure 16:
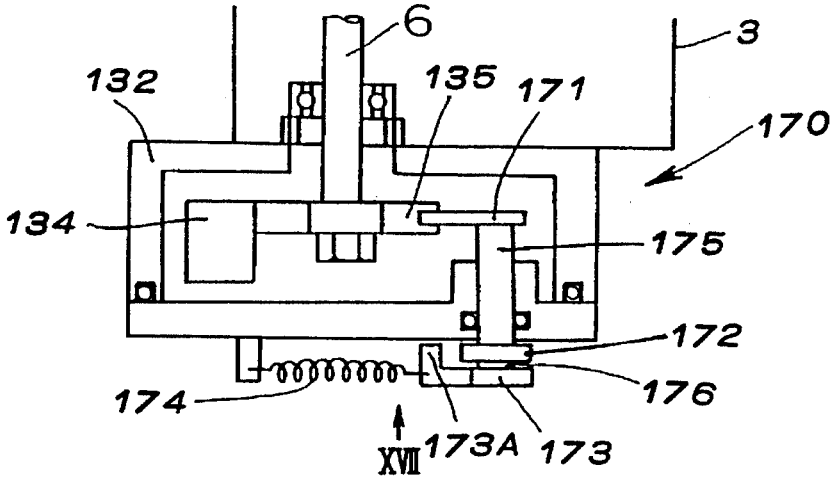
FIG. 16 is a sectional view taken along XVI—XVI in FIG. 15.
Figure 17:
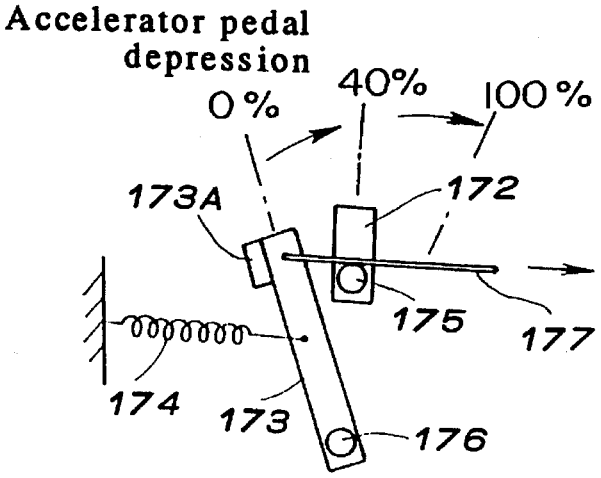
FIG. 17 is a view taken in the direction of the arrow XVII in FIG. 16.

FIG. 15 is a sectional view of a prestroke controller 170 (fourth embodiment) whose injection timing advance characteristic varies in response to the degree of depression of an accelerator pedal or the engine load condition, FIG. 16 is a sectional view taken along XVI—XVI in FIG. 15, and FIG. 17 is a view taken in the direction of the arrow XVII in FIG. 16. The prestroke controller 170 has a first lever 171 in contact with the abutment lever 135, and, as shown in FIGS. 16 and 17, a second lever 172, a third lever 173 and a tension spring 174.

The first lever 171 and the second lever 172 are both rotatable about a first pivot shaft 175 and the third lever 173 is rotatable about a second pivot shaft 176.

An accelerator wire 177 is attached to the third lever 173 such that depression of an accelerator pedal (not shown) causes the third lever 173 to rotate clockwise in FIG. 17. The third lever 173 has a lug 173A for engaging with and rotating the second lever 172 but is positioned such that the lug 173A does not engage with the second lever 172 in the range of accelerator pedal depression between 0% and 40%. As a result, the operation of the accelerator wire 177 is not transferred to the second lever 172 or the first lever 171 within this range.

As shown in FIG. 15, a compression spring 178 and a lever stop 179 are provided in association with the first ever 171.

Thus in the 0% to 40% range of accelerator pedal depression shown in FIG. 17, when the engine is normally under low load, the force of the accelerator wire 177 is not transferred to the first lever 171 and thus does not reach the abutment lever 135 or the timing control rod 6. Since the state shown in FIG. 15 is therefore maintained, it is possible to realize fuel injection timing advance when the degree of accelerator pedal depression is small.

Figure 18:
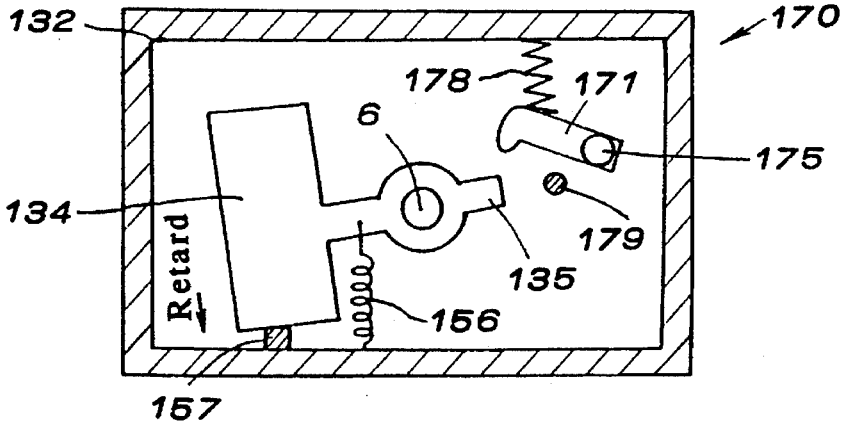
FIG. 18 is sectional view of the prestroke controller 170 showing its state when the degree of depression of the accelerator pedal exceeds 40%.
Figure 19:
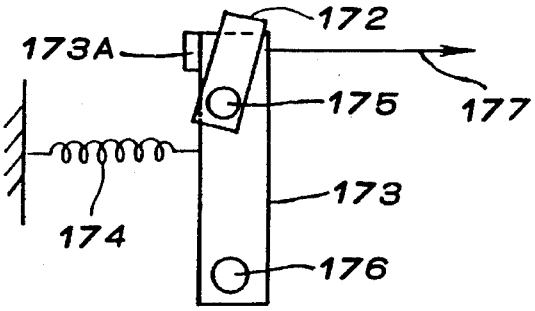
FIG. 19 is a side view similar to FIG. 17.

FIG. 18 is a sectional view showing the state of the prestroke controller 170 when the degree of depression of the accelerator pedal rises above 40% and FIG. 19 is a side view similar to FIG. 17. When the degree of depression of the accelerator pedal exceeds 40%, the lug 173A of the third lever 173 engages with the second lever 172 and rotates it clockwise therewith as seen in FIG. 19. Therefore, as shown in FIG. 18, the first lever 171 overcomes the force of the compression spring 178 and separates from the abutment lever 135, allowing the counterweight 134 to be pulled by the tension spring 156 for establishing an injection timing retard matched to the degree of accelerator pedal depression exceeding 40%.

Figure 20:
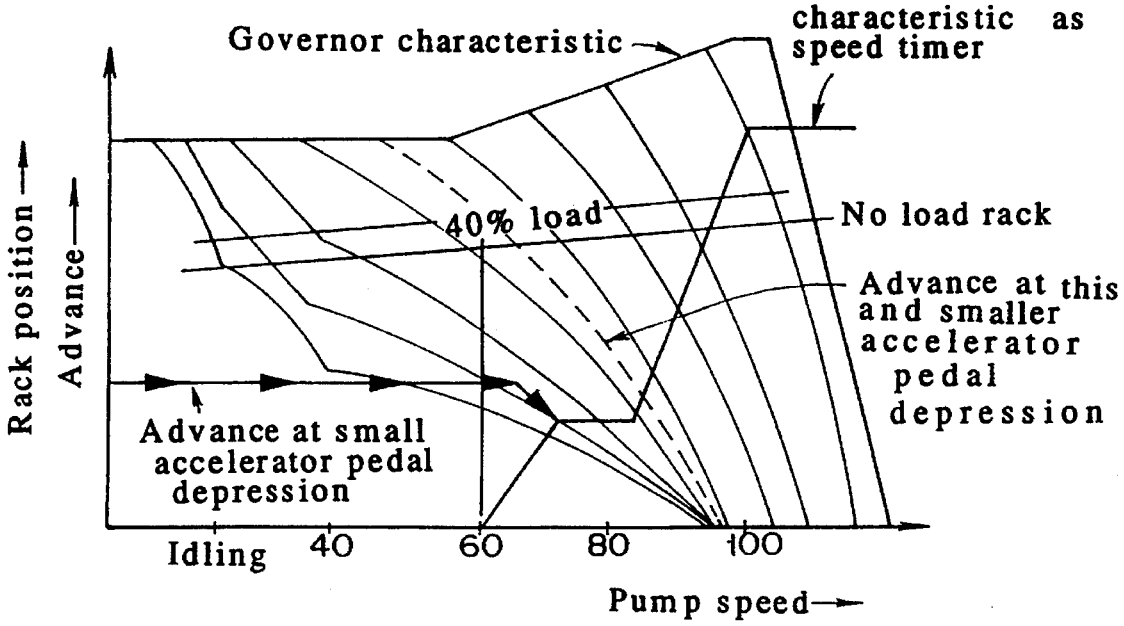
FIG. 20 is a graph showing the prestroke control based on the degree of depression of the accelerator pedal (injection timing advance characteristic) and the positional control (governor characteristic) of the injection quantity control rack 22 (FIG. 8).

FIG. 20 is a graph showing the prestroke control based on the degree of depression of the accelerator pedal (injection timing advance characteristic) and the positional control (governor characteristic) of the injection quantity control rack 22 (FIG. 8). Under a given low degree of depression of the accelerator pedal wherein, for example, the pump speed is not more than 60% and the load (or degree of depression of the accelerator pedal) is not more than 40% (broken line), the fuel injection timing can be advanced (as shown by the arrows). On the other hand, when the pump speed exceeds 60% and the accelerator pedal depression exceeds 40%, the injection timing advance characteristic of an ordinary speed timer is restored.

Figure 21:
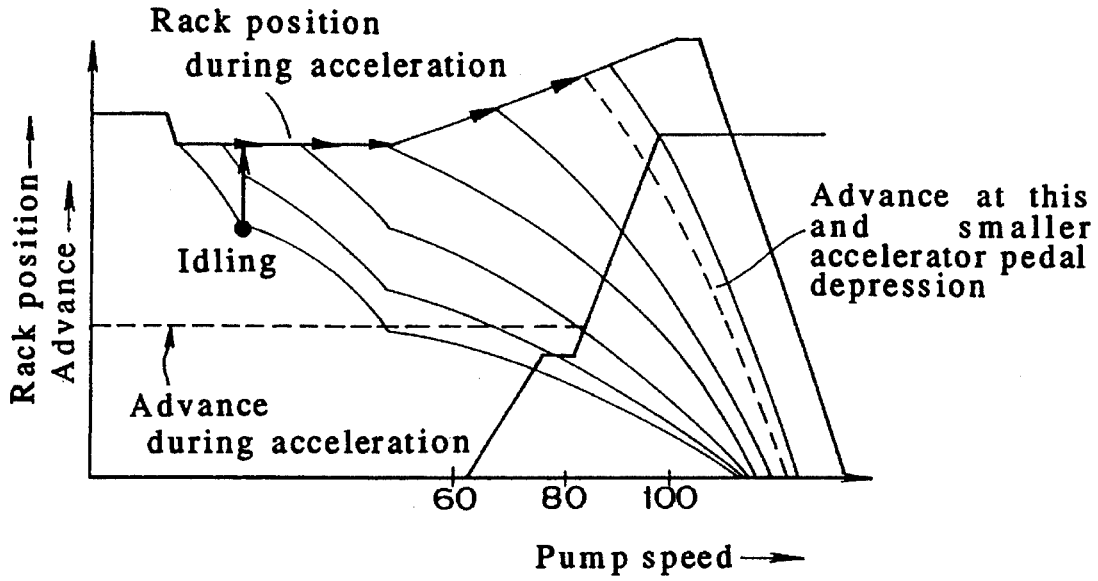
FIG. 21 is a graph showing the injection timing advance characteristic and the governor characteristic when, differently from the case of FIG. 20, the injection timing is advanced when the degree of depression of the accelerator pedal exceeds a prescribed value.

FIG. 21 is a graph showing the injection timing advance characteristic and the governor characteristic when, differently from the case of FIG. 20, the injection timing is advanced when the degree of depression of the accelerator pedal exceeds a prescribed value.

When the accelerator pedal is depressed for acceleration, for example, the fuel injection quantity can be controlled beginning from the idling state so as to follow the governor characteristic curve (as shown by the arrows) while the fuel injection timing can be advanced when the degree of depression of the accelerator pedal exceeds a prescribed level (broken line curve).

Although the configuration for obtaining this injection timing advance characteristic is not shown in the drawings, it suffices to adopt an arrangement that is the reverse of that of the prestroke controller 170 shown in FIGS. 15 to 19.

This can be realized, for example, by a configuration in which the third lever 173 disengages from the second lever 172 at a point in its rotational range corresponding to greater than a given degree of depression of the accelerator pedal. With this arrangement, further rotation of the third lever 173 does not produce additional injection timing retard and the second lever 172 and the first lever 171 are restored to the injection timing advance condition.

Figure 22:
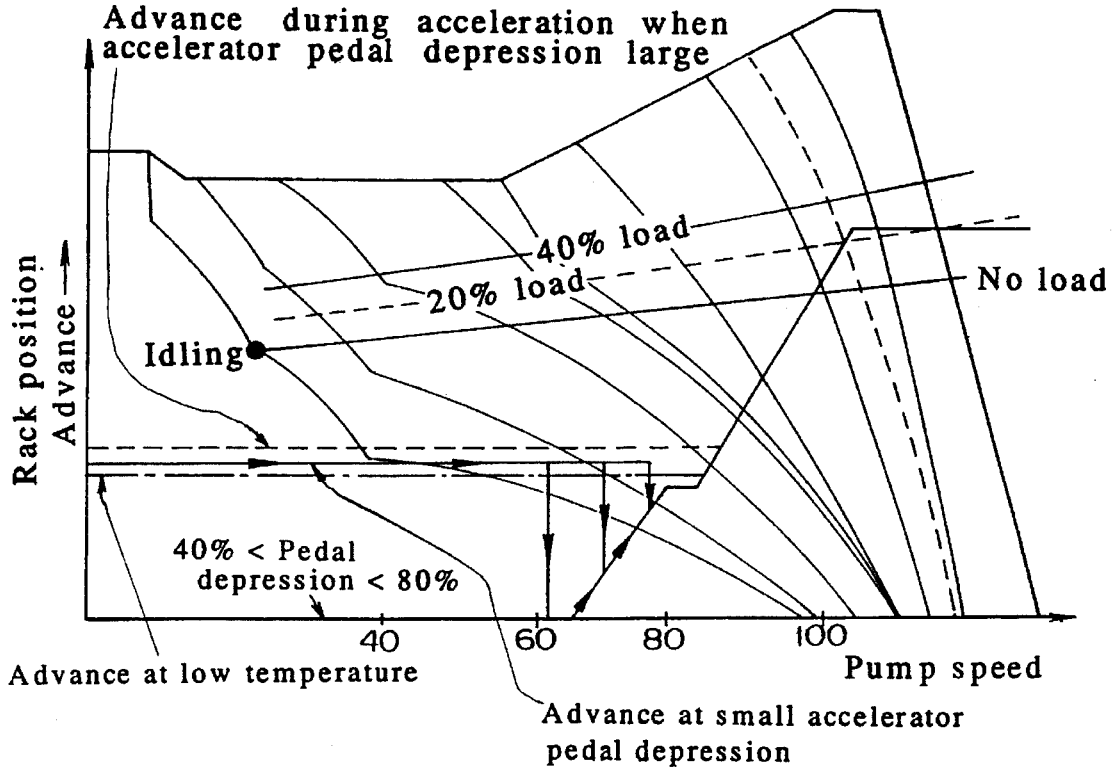
FIG. 22 is a graph showing the injection timing advance characteristic and the governor characteristic in the case of employing all of the prestroke controllers 150 (FIG. 10), 160 (FIG. 12) and 170 (FIG. 15).

FIG. 22 is a graph showing the injection timing advance characteristic and the governor characteristic in the case of employing all of the prestroke controllers 150 (FIG. 10), 160 (FIG. 12) and 170 (FIG. 15). As shown, it is possible to realize an ordinary injection timing advance characteristic responsive to engine speed and, independently of this ordinary injection timing advance characteristic, to also realize a low-temperature injection timing advance characteristic and a low-load injection timing advance characteristic.

Figure 23:
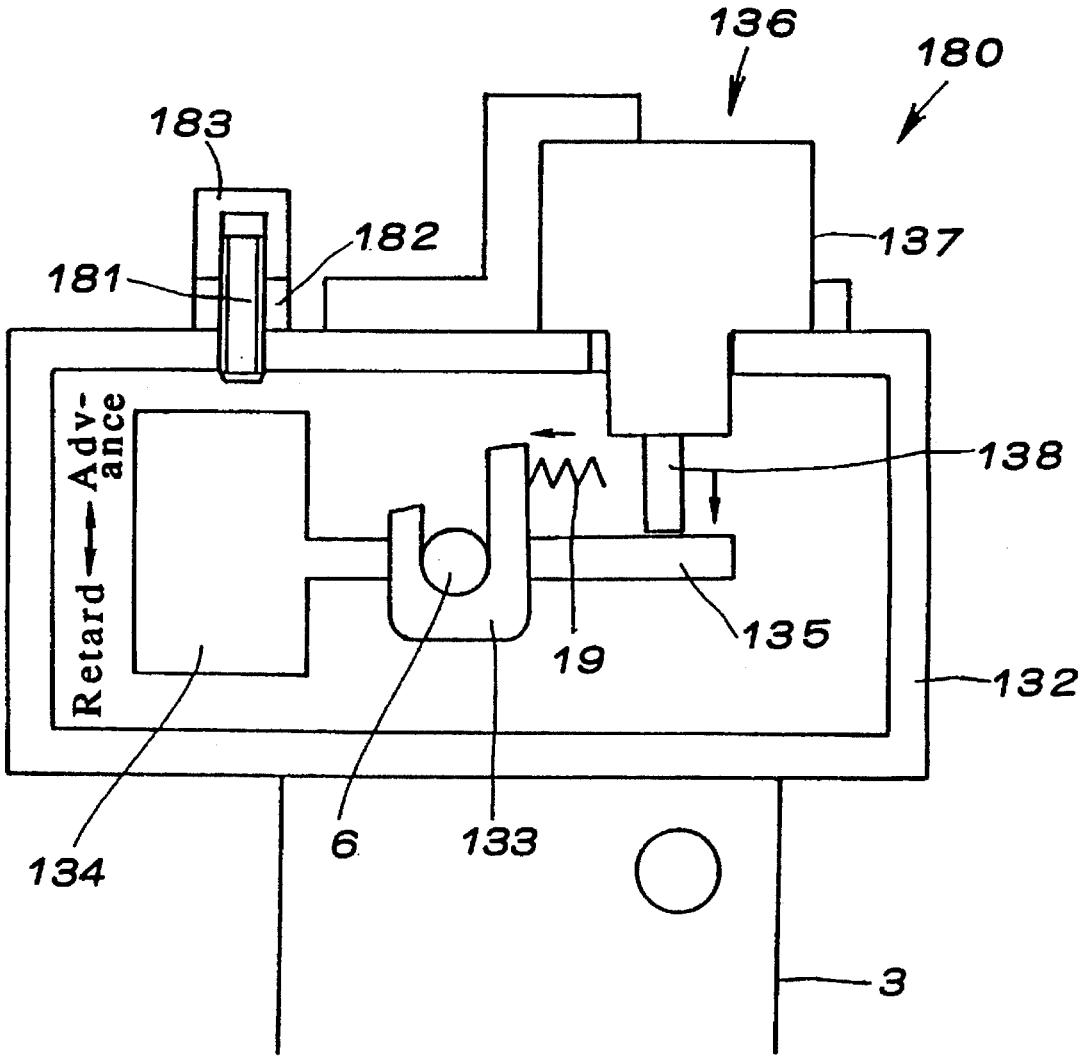
FIG. 23 is a sectional view of a prestroke controller 180 according to a first embodiment of the third aspect of the invention.

FIG. 23 is a sectional view of a prestroke controller 180 according to a first embodiment of the third aspect of the invention, configured for overcoming the problem described earlier with reference to FIGS. 4 to 7.

More specifically, in the prestroke controller 180 a limiting stop 181 is provided on the counterweight case 132 opposite the counterweight 134 for restricting the minimum prestroke.

The limiting stop 181, which is capable of determining the minimum prestroke (maximum timing advance), is equipped with a adjusting nut 182 and a cap nut 183 which enable fine adjustment of the gap between the limiting stop 181 and the counterweight 134.

Thus even if variations in ambient temperature should change the temperature characteristics of the driving side external magnet 38 and the driven side internal magnet 39 of the magnetic coupling 37, the minimum prestroke will be still be stably maintained at the prescribed value by the limiting stop 181, as indicated by hatching in FIG. 7.

The third aspect of the invention thus provides a further improvement on top of the various merits realized when, in accordance with the first aspect of the invention, the magnetic coupling 37 is used as the displacement transfer mechanism between the main pump unit 3 and the mechanical governor 2 as shown in FIG. 4. However, another problem unrelated to that explained in connection with the third aspect of the invention still remains.

As was mentioned earlier, the magnetic coupling 37 acts as a safety mechanism when sticking occurs for some reason on the timing control rod 6 side. Specifically, it allows the tension lever 13 to operate despite any such sticking and, as a result, enables the governor mechanism 20 to continue functioning as a control mechanism for the injection quantity control rack 22. If, however, the magnetic coupling 37 section should itself stick owing to some irregularity, the tension lever 13 will also be unable to move, with the result that the control function of the mechanical governor 2 (governor mechanism 20) will be lost.

Immobility of the tension lever 13 can in fact lead to overrun or some other serious problem since it makes it impossible for the mechanical governor 2 to control the fuel injection quantity. It is therefore important to equip the magnetic coupling 37 itself with some kind of safety mechanism.

The fourth aspect of the invention deals with the foregoing problem. Specifically, it provides a fuel injection pump prestroke controller which ensures continued operation of the mechanical governor even when sticking occurs in the magnetic coupling used for transferring the lift of the flyweight of the mechanical governor so as to control prestroke.

The fourth aspect of the invention is particularly aimed at establishing a safety mechanism for ensuring governor operation between a prestroke control mechanism including a mechanical governor and injection quantity control rack mechanism including a tension lever and the like. Specifically, it provides a prestroke controller for an engine fuel injection pump comprising a plunger which sucks in and pressurizes fuel by reciprocating axially in response to rotation of a cam shaft connected with the engine, a control sleeve slidably fitted on the plunger, a timing control rod connected with the control sleeve and which operates to adjust the prestroke by changing the position of the control sleeve relative to the axial direction of the plunger, a governor mechanism having a flyweight which moves in response to rotation of the cam shaft, a magnetic coupling provided at a displacement transfer section between the flyweight and the timing control rod, a prestroke control mechanism including the magnetic coupling, and a safety mechanism provided between the prestroke control mechanism and the governor mechanism for ensuring operation of the governor mechanism based on the movement of the governor mechanism even when a problem arises in the magnetic coupling.

The safety mechanism can be constituted by providing an intermediate link connected with a tension lever linked with the flyweight in the governor mechanism.

The safety mechanism can be provided either between an intermediate link connected with the tension lever linked with a flyweight of the governor mechanism and the tension lever or between the intermediate link and a sensor lever abutting on the magnetic coupling.

Since the fuel injection pump prestroke controller in accordance with the fourth aspect of the invention is provided with the safety mechanism between the prestroke controller including the magnetic coupling and the governor mechanism (fuel injection quantity control rack control mechanism), the safety mechanism section ensures that the governor itself can fulfill its function even if sticking occurring in the magnetic coupling for some reason should prevent the operation of the prestroke control mechanism. As a result, a problem arising in the magnetic coupling can be prevented from causing a problem in the mechanical governor.

Since it is therefore possible for the governor mechanism to normally fulfill its function of automatically controlling the fuel injection quantity in response to load variations, problems that might be caused by irregular operation can be avoided.

A prestroke controller for fuel injection pump that is a first embodiment of the fourth aspect of the invention will now be explained with reference to FIGS. 24 and 25.

Figure 24:
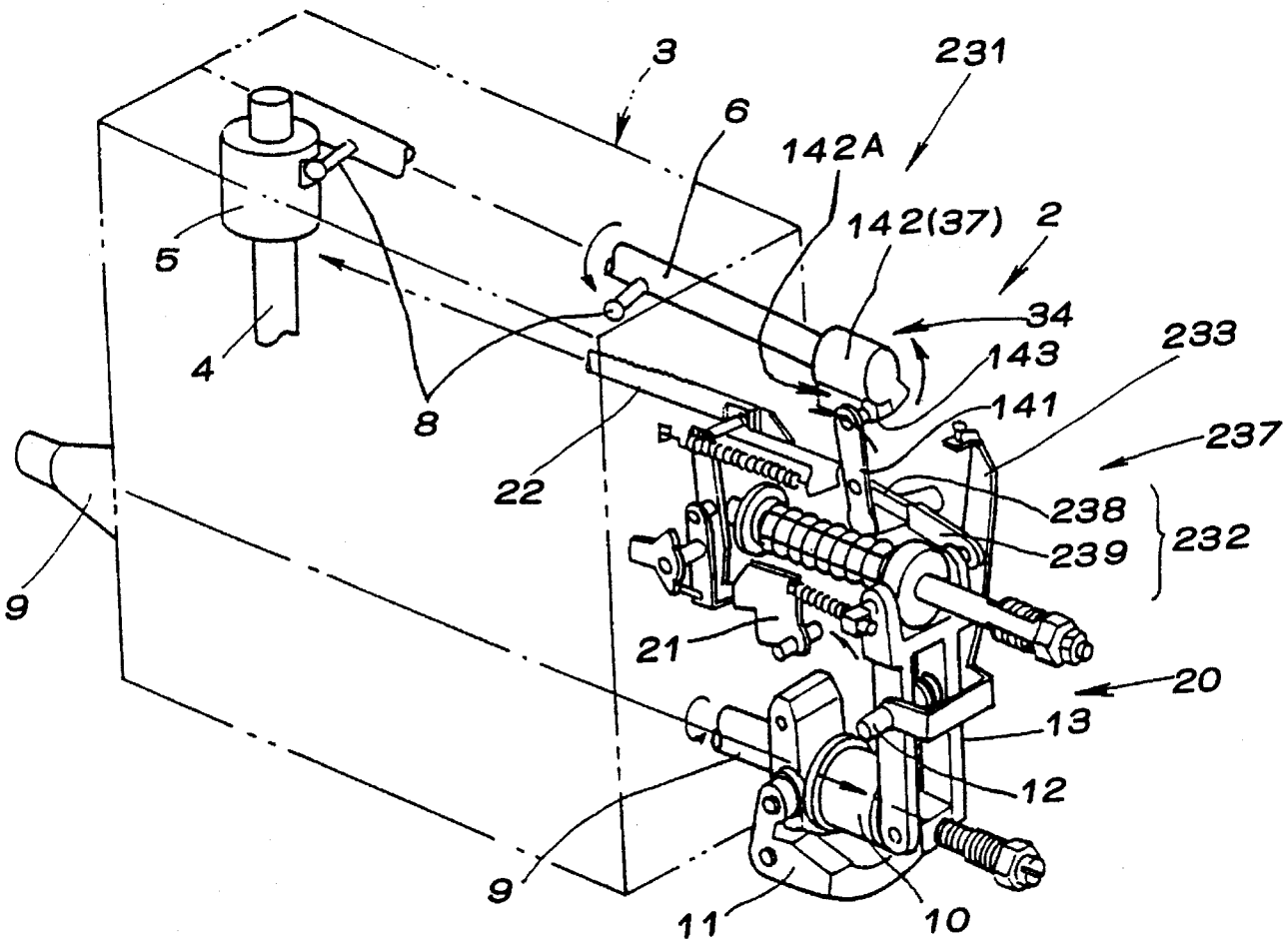
FIG. 24 is a simplified perspective view of a fuel injection pump 230 equipped with a prestroke controller 231 according to a first embodiment of a fourth aspect of the invention.

FIG. 24 is a simplified perspective view of a fuel injection pump 230. The fuel injection pump 230 comprises an in-line main pump unit 3, a prestroke controller 231 (first embodiment of the fourth aspect of the invention), and a mechanical governor 2.

On the mechanical governor 2 side of the prestroke controller 231, the prestroke can be controlled in accordance with the engine speed (pump speed) by co-utilizing the flyweight 11 of the mechanical governor 2.

More specifically, a tension lever 13 (similar to that shown in FIG. 1) has an intermediate link 232 and a guide lever 233 attached thereto, and a sensor lever (control lever) 141 is attached to the intermediate link 232.

A cylindrical cam 142 (similar to that shown in FIG. 8) is fitted on the end portion of the timing control rod 6 opposite the mechanical governor 2 and an abutment pin 143 of the sensor lever 141 is abutted on the cam surface 142A of the cylindrical cam 142.

A magnetic coupling 37 (FIG. 4) is built into the cylindrical cam 142 and the rotation of the cylindrical cam 142 is transferred to the timing control rod 6 through the magnetic coupling 37. The control sleeve 5 can therefore be moved vertically with respect to the plunger 4 to adjust the prestroke in the manner explained earlier.

A safety mechanism 237 is provided at the intermediate link 232 between the tension lever 13 and the sensor lever 141. By ensuring the operation of the tension lever 13 the safety mechanism 237 guarantees that the torque cam 21 and the mechanical governor 2 will perform their functions even if the cylindrical cam 142 should stick and become immovable for some reason.

Figure 25:
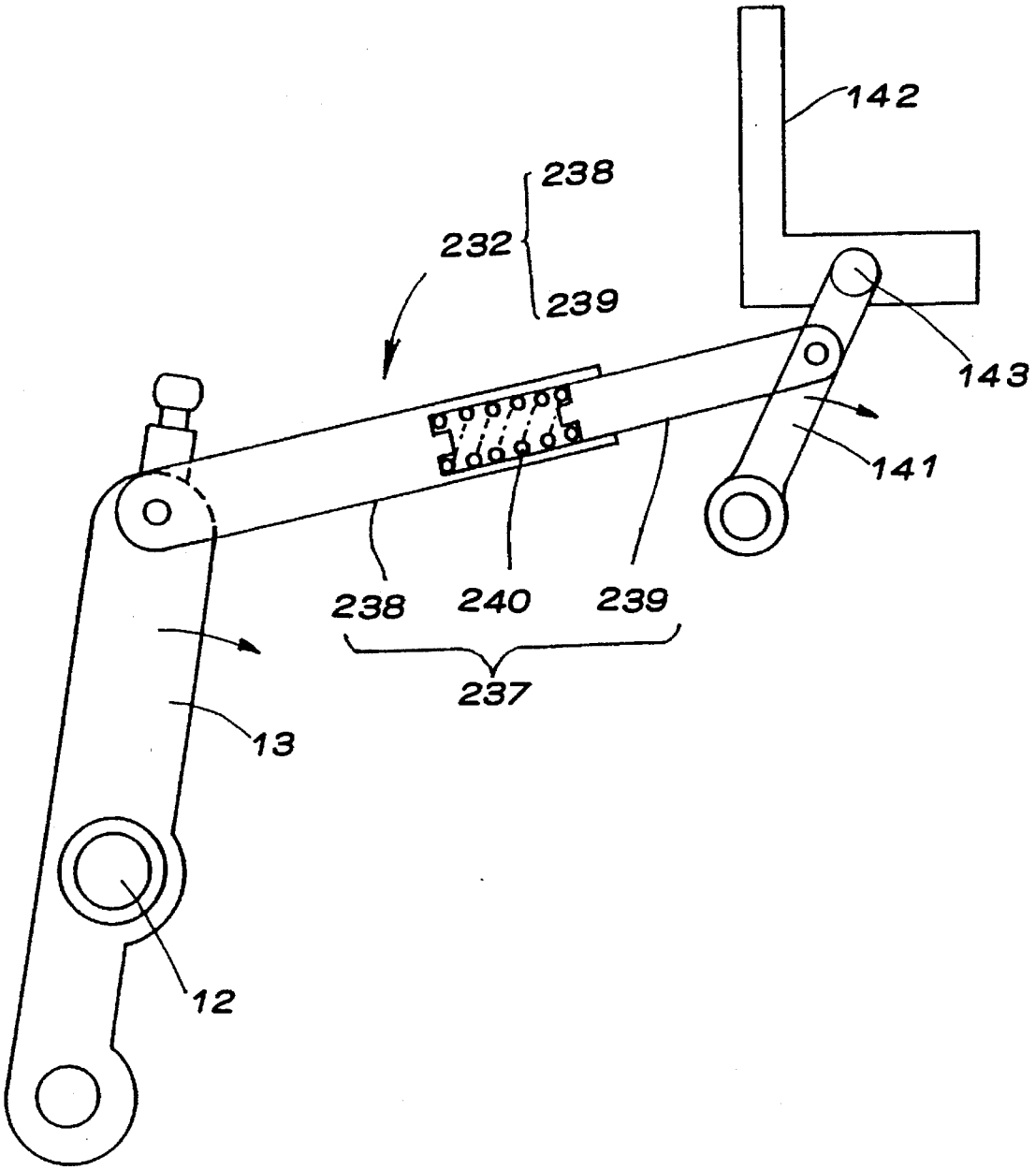
FIG. 25 is an enlarged side view showing the essential portion of a specific arrangement of a safety mechanism 237 of the fuel injection pump 231.

FIG. 25 is an enlarged side view showing the essential portion of a specific arrangement of the safety mechanism 237. The safety mechanism 237 is constituted by dividing the intermediate link 232 into a first intermediate link section 238 connected with the tension lever 13 side and a second intermediate link section 239 connected with the sensor lever 141 side and inserting a compression spring 240 between the two sections.

Therefore when the tension lever 13 rotates clockwise about the stationary pivot shaft 12 as seen in FIG. 25, the first intermediate link section 238 transfers its displacement to the second intermediate link section 239 while compressing the compression spring 240, the second intermediate link section 239 rotates the sensor lever 141 clockwise, and the abutment pin 143 of the sensor lever 141 rotates the cylindrical cam 142.

The prestroke controller 231 configured in the foregoing manner operates similarly to the fuel injection pump prestroke controller 1 of FIG. 1 in the point that the movement of the flyweight 11 with increasing engine speed is used to rotate the tension lever 13 and, in turn, to rotate the intermediate link 232 and the control lever 141 in the direction of the arrow.

As a result, the abutment pin 143 pushes against the cam surface 142A of the cylindrical cam 142 to rotate the cylindrical cam 142 counterclockwise in FIG. 24 and the resulting rotation of the timing control rod 6 is transferred to the engagement pin 8 which lowers the control sleeve 5, thereby shortening the prestroke and advancing the fuel injection timing.

Even if the cylindrical cam 142 or the magnetic coupling 37 should happen to stick and become immovable, thus also making the second intermediate link section 239 immovable, the movement of the flyweight 11 will still be able to rotate the tension lever 13 because the first intermediate link section 238 will be able to overcome the force of the compression spring 240 and move the required distance in the direction of the second intermediate link section 239. Thus, since the displacement of the tension lever 13 needed for the governor mechanism 20 to function can be secured, the fuel injection quantity function of the governor mechanism 20 will not be disabled.

Obviously the ability of the tension lever 13 to rotate counterclockwise in FIG. 25 is also ensured.

Figure 26:
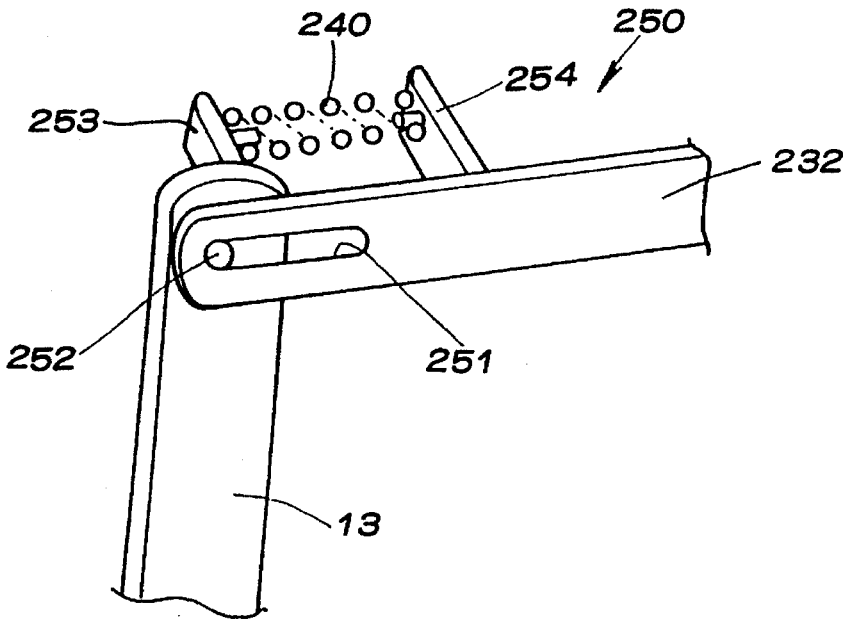
FIG. 26 is an enlarged view showing the essential portion of a safety mechanism 250 in a prestroke controller according to a second embodiment of the fourth aspect of the invention.

FIG. 26 is an enlarged view showing the essential portion of a safety mechanism 250 in a prestroke controller according to a second embodiment of the fourth aspect of the invention. The safety mechanism 250 is constituted by forming an elongate hole 251 in the intermediate link 232 at the portion where it connects with the tension lever 13, fitting a pivot shaft 252 of the tension lever 13 into the elongate hole 251, and inserting a compression spring 240 between a first spring seat 253 extending from the tension lever 13 and a second spring seat 254 extending from the intermediate link 232.

Similarly to the safety mechanism 237, the safety mechanism 250 configured in the foregoing manner also ensures operation of the tension lever 13 even if sticking should occur owing to a problem in the cylindrical cam 142.

Figure 27:
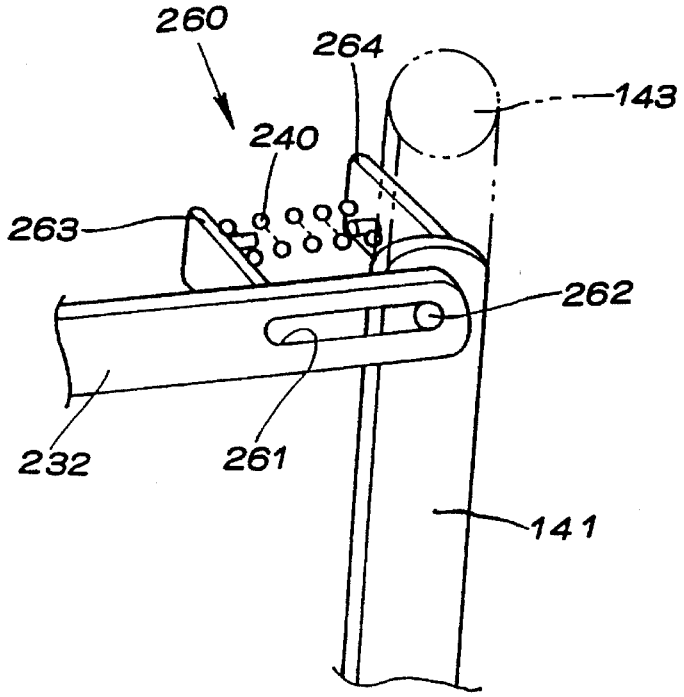
FIG. 27 is an enlarged view showing the essential portion of a safety mechanism 260 in a prestroke controller according to a third embodiment of the fourth aspect of the invention.

FIG. 27 is an enlarged view showing the essential portion of a safety mechanism 260 in a prestroke controller according to a third embodiment of the fourth aspect of the invention. The safety mechanism 260 is constituted by forming an elongate hole 261 in the intermediate link 232 at the portion where it connects with the sensor lever 141, fitting a pivot shaft 262 of the sensor lever 141 into the elongate hole 251, and inserting the compression spring 240 between a first spring seat 263 extending from the intermediate link 232 and a second spring seat 264 extending from the sensor lever 141.

Similarly to the safety mechanism 237, the safety mechanism 260 configured in the foregoing manner also ensures operation of the tension lever 13 even if sticking should occur owing to a problem in the cylindrical cam 142.

The safety mechanism according to the fourth aspect of the invention can alternatively be provided at some other link connection portion, such as between the intermediate link 232 and the tension lever 13. Any arrangement that can ensure rotation of the tension lever 13 with movement of the flyweight 11 suffices in principle. Specifically, the safety mechanism can be constituted by any pair of displacement members (238, 239; 13, 232; 141, 232; etc.) which are displaced with respect to each other based on the movement of the flyweight 11 and by a spring that exerts a force in the direction opposite to the displacement allowed by the displacement members.

As will be understood from the foregoing explanation, in the first aspect of the invention the use of the magnetic coupling at the displacement transfer section enables the rotational force of the displacement transfer section of the governor to be transferred to the timing control rod of the main pump unit without need for an oil seal or the like.

The second aspect of the invention exploits the merits of a magnetic coupling to enable provision of an add-on device for advancing fuel injection timing independently of the movement of a flyweight and by providing such an injection advance adjustment add-on device makes it possible to realize low-temperature injection timing advance and low-load injection timing advance, thereby providing greater freedom in establishing injection timing advance characteristics.

In the third aspect of the invention, the provision of a limiting stop in conjunction with the counterweight connected with the timing control rod makes it possible to limit the minimum prestroke position, whereby a minimum prestroke can be stably secured unaffected by the temperature dependence of the driving side external magnet and the driven side internal magnet of the magnetic coupling.

In the fourth aspect of the invention, the provision of a safety mechanism between the prestroke control mechanism (including the cylindrical cam and the magnetic coupling) and the governor (including the flyweight, tension bar etc.) ensures normal operation of the tension bar and other components of the governor mechanism even in situations where sticking occurs owing to a problem in the cylindrical cam or magnetic coupling, whereby the fuel injection quantity control function of the governor mechanism can be secured at all times.

What is claimed is:

1. A fuel injection pump for an engine comprising a main pump unit, a timing control rod, a control sleeve whose position is varied by the timing control rod for controlling injection timing, a partition for separating the timing control rod from a displacement transfer section of a mechanical governor, and a magnetic coupling straddling the partition, the position of the control sleeve being controlled by transferring rotation of the displacement transfer section caused by centrifugal force of a flyweight to the timing control rod through the magnetic coupling.

2. A fuel injection pump according to claim 1, wherein the displacement transfer section comprises a displacement transfer shaft and the magnetic coupling straddling the partition is provided between the displacement transfer shaft and the timing control rod.

3. A fuel injection pump according to claim 1, wherein the main pump unit comprises a plunger which sucks in and pressurizes fuel by reciprocating axially in response to rotation of a cam shaft connected with the engine, the control sleeve is slidably fitted on the plunger, and the timing control rod is connected with the control sleeve and is operated to adjust the prestroke by changing the position of the control sleeve relative to the axial direction of the plunger.

4. A fuel injection pump according to claim 1, wherein the partition isolates engine oil in the mechanical governor from fuel in the main pump unit.

5. A prestroke controller for an engine fuel injection pump comprising a main pump unit having a plunger which sucks in and pressurizes fuel by reciprocating axially in response to rotation of a cam shaft connected with the engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, and an add-on device for injection timing advance adjustment engageable with the timing control rod for controlling the prestroke independently of the magnetic coupling.

6. A prestroke controller according to claim 5, wherein the add-on device is provided on the side of the main pump unit opposite from that on which the displacement transfer section is provided.

7. A prestroke controller according to claim 5, further comprising a lever connected with the timing control rod, the add-on device controlling the prestroke by rotating the timing control rod through the lever.

8. A prestroke controller according to claim 5, further comprising a spring for urging the timing control rod in the direction of injection timing retard.

9. A prestroke controller according to claim 5, wherein the add-on device is a temperature injection timing advance member for controlling the prestroke in response to temperature.

10. A prestroke controller according to claim 9, wherein the add-on device includes a device housing, a wax material contained in the device housing, the volume of which wax material varies reversibly in response to temperature, and a control shaft which projects/retracts from the device housing in response to variation in the volume of the wax material.

11. A prestroke controller according to claim 10, further comprising a lever connected with the timing control rod, the control shaft rotating the timing control rod through the lever.

12. A prestroke controller according to claim 10, further comprising an intermediate lever, the control shaft rotating the timing control rod through the intermediate lever.

13. A prestroke controller according to claim 9, wherein the add-on device includes a shape memory alloy spring whose force varies reversibly in response to temperature, the shape memory alloy spring being connected with the timing control rod.

14. A prestroke controller according to claim 5, wherein the add-on device is a load injection timing advance member for controlling the prestroke in response to engine load.

15. A prestroke controller according to claim 5, wherein the timing control rod has an abutment lever and the add-on device includes a first lever abuttable on the abutment lever, a second lever having a first pivot shaft in common with the first lever, a third lever which is capable of contacting with/separating from the second lever within a prescribed rotational ranges and which rotates about a second pivot shaft in response to engine load, a spring for urging the first lever toward the abutment lever of the timing control rod, and a spring for urging the third lever away from the second lever.

16. A prestroke controller according to claim 5, wherein the displacement transfer section has a cylindrical cam with a cam surface and the magnetic coupling is provided between the cylindrical cam and the timing control rod.

17. A prestroke controller for an engine fuel injection pump comprising a plunger which sucks in and pressurizes fuel by reciprocating axially in response to rotation of a cam shaft connected with the engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, a counterweight attached to the timing control rod, and a limiting stop provided opposite the counterweight for determining a minimum prestroke independently of the magnetic coupling.

18. A prestroke controller according to claim 17, further comprising a spring for urging the timing control rod in the direction of injection timing retard.

19. A prestroke controller according to claim 17, further comprising an add-on device for injection timing advance adjustment engageable with the timing control rod for controlling the prestroke independently of the magnetic coupling.

20. A prestroke controller according to claim 17, wherein the displacement transfer section has a cylindrical cam with a cam surface and the magnetic coupling is provided between the cylindrical cam and the timing control rod.

21. A prestroke controller for an engine fuel injection pump comprising a plunger which sucks in and pressurizes fuel by reciprocating axially in response to rotation of a cam shaft connected with the engine, a control sleeve slidably fitted on the plunger, a timing control rod connected with the control sleeve and which operates to adjust the prestroke by changing the position of the control sleeve relative to the axial direction of the plunger, a governor mechanism having a flyweight which moves in response to rotation of the cam shaft, a magnetic coupling provided at a displacement transfer section between the flyweight and the timing control rod, a prestroke control mechanism including the magnetic coupling, and a safety mechanism provided between the prestroke control mechanism and the governor mechanism for ensuring operation of the governor mechanism based on the movement of the flyweight even when a problem arises in the magnetic coupling.

22. A prestroke controller according to claim 21, wherein the governor mechanism includes a tension lever linked with the flyweight and an intermediate link connected with the tension lever, the safety mechanism being provided on the intermediate link.

23. A prestroke controller according to claim 21, wherein the governor mechanism includes a tension lever linked with the flyweight, an intermediate link connected with the tension lever and a sensor lever that abuts on the magnetic coupling, the safety mechanism being provided between the intermediate link and the tension lever or between the intermediate link and the sensor lever.

24. A prestroke controller according to claim 21, wherein the safety mechanism includes a pair of displacement members displaced with respect to each other based on movement of the flyweight and a spring that exerts a force in the direction opposite to the displacement allowed by the displacement members.

25. A prestroke controller according to claim 21, wherein the displacement transfer section has a cylindrical cam with a cam surface and the magnetic coupling is provided between the cylindrical cam and the timing control rod.

* * * * *